United States Patent [19]

Niina et al.

[11] Patent Number: 4,996,937

[45] Date of Patent: Mar. 5, 1991

[54] SMALL BOAT

[75] Inventors: Jiro Niina, Kobe; Ryuji Kajio; Mamoru Shitamori, both of Akashi, all of Japan

[73] Assignee: Kawasaki Jukogyo Kabushiki Kaisha, Kobe, Japan

[21] Appl. No.: 252,569

[22] Filed: Sep. 30, 1988

[30] Foreign Application Priority Data

Sep. 30, 1987 [JP] Japan ..... 62-247638
Oct. 7, 1987 [JP] Japan ..... 62-153546

[51] Int. Cl.[5] ..... B63H 21/00

[52] U.S. Cl. ..... 114/144 R; 114/211; 114/290; 114/202; 114/78; 74/480 B; 440/111; 297/191

[58] Field of Search ..... 440/88, 53, 111, 112, 440/11, 12; 244/234; 297/191; 180/332, 333, 78; 74/469, 470, 480 R, 491, 480 B, 492; 114/211, 288, 290, 201 R, 202, 203, 78, 144 R, 146, 173, 177

[56] References Cited

U.S. PATENT DOCUMENTS

| | | | |
|---|---|---|---|
| 51,504 | 12/1865 | Wells | 114/211 |
| 117,484 | 7/1871 | Thiers | 114/211 |
| 3,810,440 | 5/1974 | Johnson | 114/144 R |
| 3,826,216 | 7/1974 | Rhody | 440/12 |
| 3,834,340 | 9/1974 | Thorpe | 114/201 R |
| 3,845,839 | 11/1974 | Eriksson | 114/201 R |
| 3,935,832 | 2/1976 | Bawden | 440/11 |
| 3,983,834 | 10/1976 | Hirmann | 114/144 R |
| 4,091,761 | 5/1978 | Fehn | 114/290 |
| 4,478,166 | 10/1984 | Sorensen | 114/290 |
| 4,509,926 | 4/1985 | Jacobson | 114/211 |
| 4,537,147 | 8/1985 | Nivin | 114/201 R |
| 4,571,338 | 4/1985 | Fanelli | 114/144 R |
| 4,636,176 | 1/1987 | Capilla | 440/11 |
| 4,664,051 | 5/1987 | Newkirk | 440/11 |
| 4,687,447 | 8/1987 | Hannappel | 440/12 |
| 4,694,770 | 9/1987 | Kitner | 440/12 |
| 4,811,680 | 3/1989 | Genth | 114/211 |
| 4,819,575 | 4/1989 | Nixon | 440/11 |

*Primary Examiner*—Joseph F. Peters, Jr.
*Assistant Examiner*—Clifford T. Bartz
*Attorney, Agent, or Firm*—Marshall, O'Toole, Gerstein, Murray & Bicknell

[57] ABSTRACT

A small boat comprising a helmseat positioned at the center of the forward half of the boat, and a control stick for steering the boat positioned at the front of this helmseat. Since the helmseat is positioned at the center of the forward half of the boat, the driver is located approximately equidistant from the left and right gunwales, which makes it easier to steer the boat. In addition, a control stick is positioned to the front of the helmseat, and, because this control stick can be used to steer the boat and also to change the direction of the boat, the amount of space required to steer the boat is less than that required in a design wherein steering is performed by turning a circular steering wheel, such as with the prior art already described. This is effective particularly for a small boat moving at a high speed.

3 Claims, 17 Drawing Sheets

FIG. 25
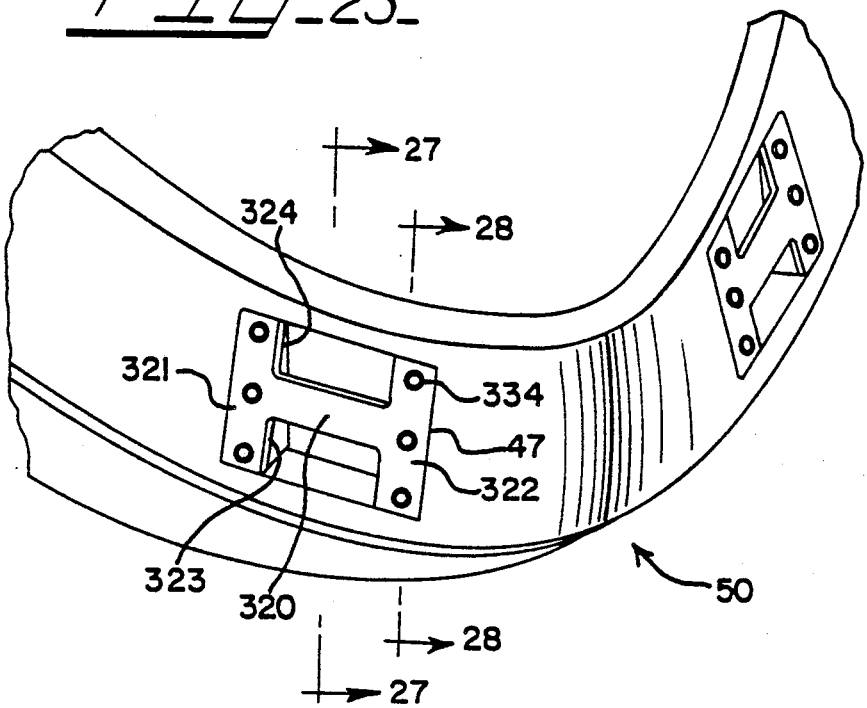
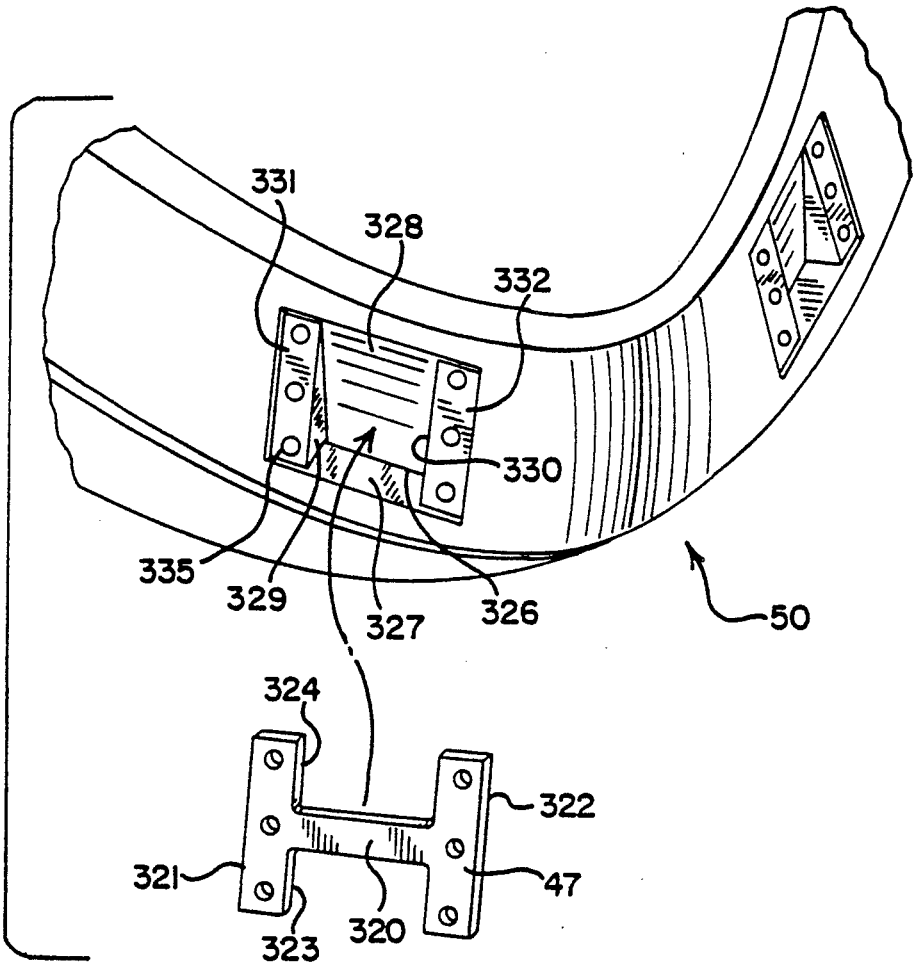

SMALL BOAT

FIELD AND BACKGROUND OF THE INVENTION

This invention relates to a small engine driven boat.

In a typical prior art small boat, for example, as described in Japanese Patent Provisional Publication No. 55-2510, the steer seat or helmseat is located toward one of the sides or gunwales, a circular frame-like steering wheel is provided for steering the boat and a control box for operating the internal combustion engine are located to the front of this helmseat, and a passenger seat is located toward the other side or gunwale from the helmseat.

With this type of prior art, because the helmseat is located toward one of the gunwales, it is difficult to know the exact position of the other side of the boat while steering, and also operation of both the steering wheel and the control box is required.

In addition, not only is space required for the control box, but also, because the boat is steered by turning the circular steering wheel, a relatively large amount of space is required in which to operate the steering wheel. Moreover, in order to, for example, turn the rudder all the way in one direction, the steering wheel must be turned over a large angle, such as about two complete revolutions in one direction, and thus it is not easy to quickly turn the boat.

The general object of this invention is to provide a small boat in which the steering operation is made easy by the combination of the functions of both the steering wheel and the control box in a single control stick, and in which the amount of space required to perform the steering operation is reduced.

SUMMARY OF THE INVENTION

A small boat in accordance with this invention comprises a helmseat positioned at the center of the forward half of the boat, and a control stick for steering the boat positioned to the front of this helmseat. Since the helmseat is positioned at the center of the forward half of the boat, the driver is located approximately equidistant from the left and right gunwales, which makes it easier to steer the boat. In addition, a control stick is positioned to the front of the helmseat, and, because this control stick can be used to steer the boat and also to change the direction of the boat, the amount of space required to steer the boat is less than that required in a design wherein steering is performed by turning a circular steering wheel, such as with the prior art already described. This is effective particularly for a small boat moving at a high speed.

BRIEF DESCRIPTION OF THE DRAWINGS

FIG. 25 shows a perspective view of one of the handles in the area of the bow of the boat body;

FIG. 26 shows an exploded perspective view of one of the handles and the surrounding area;

DETAILED DESCRIPTION OF THE DRAWINGS

Figure 1:
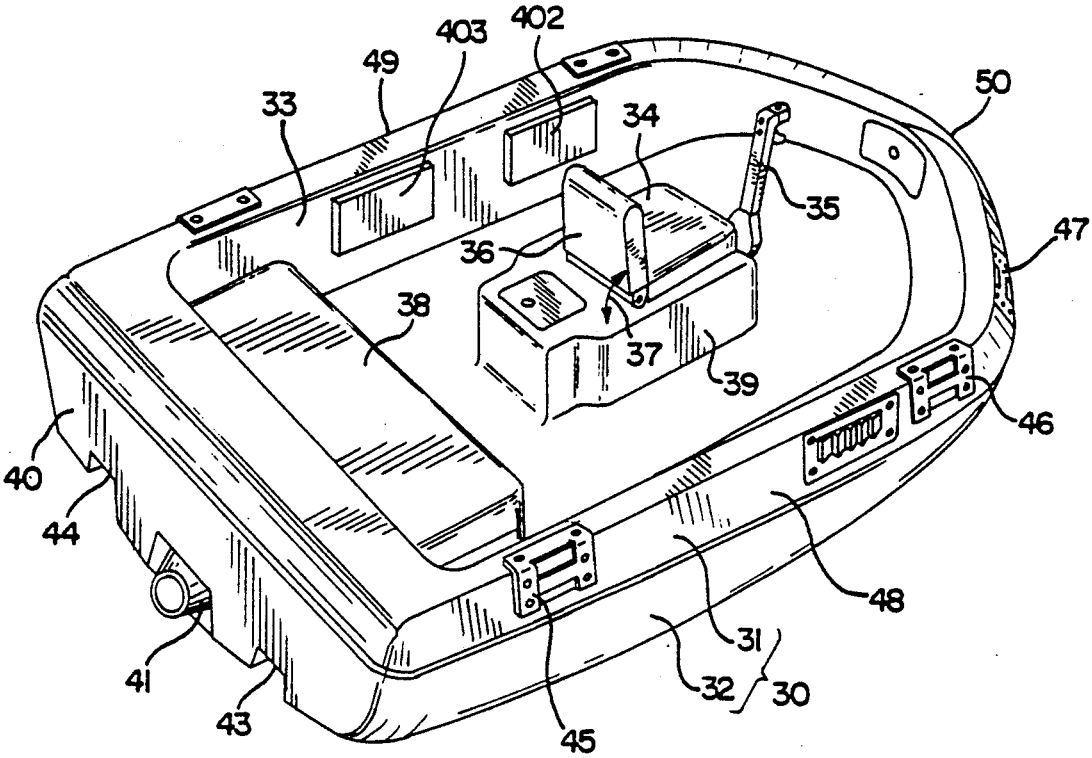
FIG. 1 shows a perspective view of the small boat according to one embodiment of this invention.

In reference to FIG. 1, the body 30 of a small boat according to the invention comprises an upper deck 31 and a lower hull 32 made of, for example, reinforced plastic and fastened together. In the passenger area 33 formed by this deck 31 is provided a steering or helmseat 34 made, for example, of urethane foam. This helmseat 34 is positioned in the forward half of the boat, midway between the left and right sides or gunwales. To the front of the helmseat 34 and near the helmseat 34 is provided a control stick 35 formed of, for example, cast aluminum or a similar material. The helmseat 34 is designed so that the backrest 36 can be either raised upright as shown or, as indicated by the arrow 37, angularly displaced so that it folds down flush with the helmseat 34. The helmseat 34 is secured to a cover 39 for an engine.

To the rear of the helmseat 34 is provided a passenger seat 38 where at least two passengers can sit.

The overall shape of the boat body 30 is a box or rectangular in shape, it being shorter lengthwise (left and right as seen in FIG. 1) and it is wider than conventional small boats of this type, giving the boat a rather pudgy appearance. At the stern 40 is provided a nozzle 41 for jet propulsion, and the boat can be steered by using the control stick 35 to angularly displace this nozzle 41 around its vertical axis. In addition, the operation of this control stick 35 also controls the opening and closing of the throttle valve of the internal combustion engine in order to adjust the propulsion force.

The bottom of the boat, which is the lower part of the hull 32, has the shape of a so-called shallow-draft trimaran, and in order to improve the boat's straight-ahead characteristics and prevent it from slipping sideways, channels 43 and 44 are provided extending in the longitudinal direction.

On the outer sides of the deck 31 of the boat body 30 are provided handles 45, 46, and 47, and these handles 45, 46, and 47 (to be described hereinafter) do not protrude outwardly, so that the outer surfaces of the boat body 30 are approximately smooth.

By positioning the helmseat 34 in the forward half of the boat midway between the left and right gunwales, the driver of the boat is approximately equidistant from the left and right gunwales 48 and 49.

The control stick 35 is positioned to the front of the helmseat 34, and the driver sitting in the helmseat 34 can angularly displace this control stick 35, which extends to approximately the same height at the top part of the sides of the deck 31, with one hand in order to steer and change the direction of the bow 50. Thus, there is little space required for the steering operation.

By folding the backrest 36 down from the upright position as indicated by the arrows 37 so that it is flush with the helmseat 34 on the cover 39, it is possible for the driver to lie down across the helmseat 34, the backrest 36, and the passenger seat 38 to find a comfortable position, and, in addition, when packing and transporting the boat, because the backrest 36 does not protrude above the height of the boat body 30 when it is folded down, packing and transporting is accomplished with greater ease.

The upper end of the control stick 35 is, for example, slightly higher than the top of the helmseat 34, and, moreover, is approximately the same height as the top part of the deck 31 of the boat body 30, thus making it easier to pack and transport the boat. Because watertight recesses 402 and 403 are provided in the interior sides of the deck of the boat body 30, various small articles needed on the boat can be stored therein.

Figure 2:
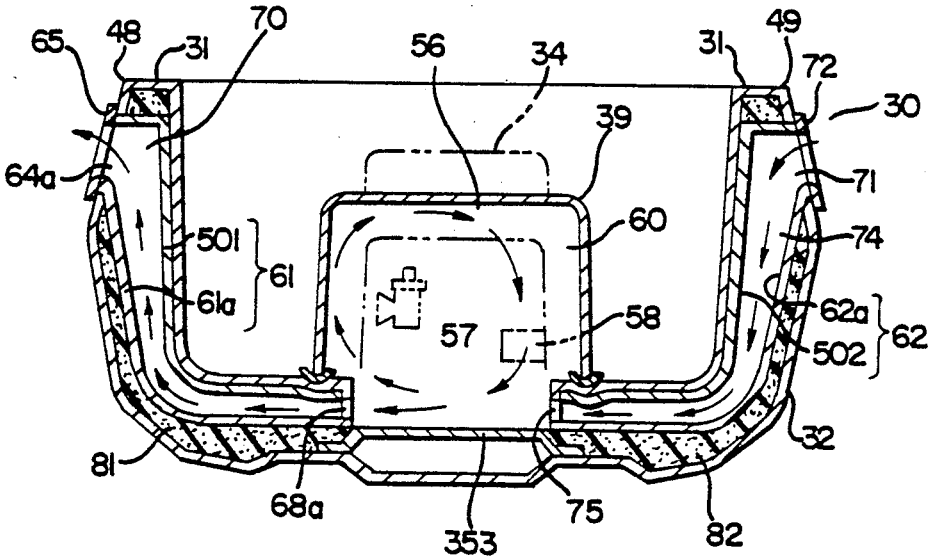
FIG. 2 shows a transverse cross-sectional view of the boat in the area of the helmseat.
Figure 3:
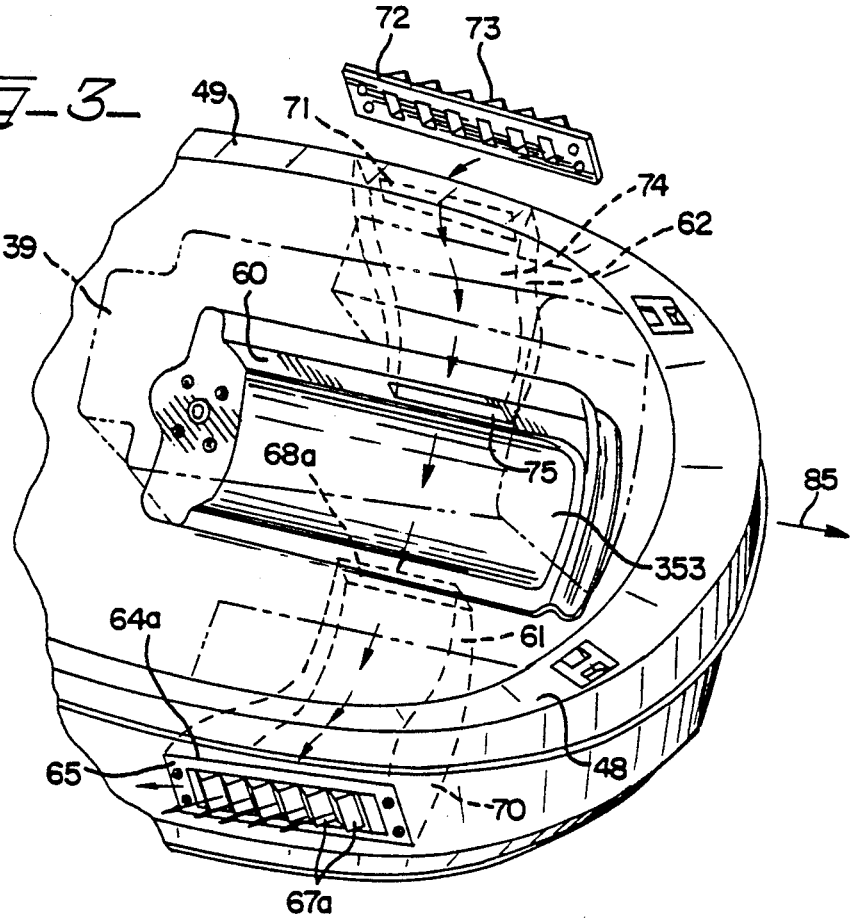
FIG. 3 shows a simplified perspective view of the front portion of the boat.

FIG. 2 shows a transverse cross-sectional view of the boat body 30 in the area of the helmseat 34, and FIG. 3 shows a simplified perspective view in that same area. On the bottom of the boat, which is the lower part of the hull 32, an engine support member 353 is secured, and to this support member 353 are mounted the engine mounting member 370 (FIG. 29), which will be explained later, the internal combustion engine 56, and related components, such as the carburetor 57 and the muffler 58. The internal combustion engine 56, etc., are concealed by the cover 39, thus forming an engine compartment 60 in which the internal combustion engine 56, etc., are contained. In order to ventilate this engine compartment 60, ventilation members 61 and 62 form flow channels in the space between the deck 31 and the hull 32.

Figure 4:
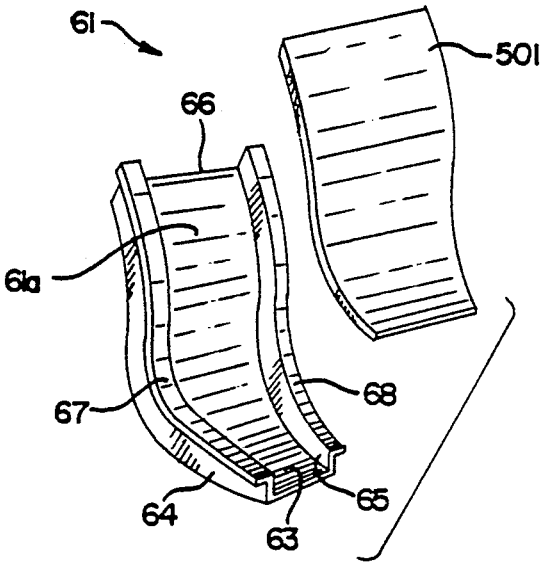
FIG. 4 shows an exploded perspective view of a ventilation member.

FIG. 4 shows an exploded perspective view of the ventilation member 61. The ventilation member body 61*a*, bottom 63, and sides 64 and 65 form a U-shaped channel 66. At the upper edges of the sides 64 and 65, flanges 67 and 68 are formed, and to the upper surfaces of the flanges 67 and 68, a cover member 501 is secured with adhesive, etc., thus forming the ventilation member 61 (refer to FIGS. 2 and 3). The ventilation member 61 is secured to the underside of the deck 48 with adhesive, or with bolts or some other means. Note that it is also possible for the ventilation member body 61*a* and the cover member 501 of the ventilation member 61 to be formed in one piece.

In the outer side of the gunwale 49 is formed an opening 71, and to this opening 71 is secured a baffle member 72 (FIG. 3). This baffle member 72 has openings and guide vanes 73 (refer to FIG. 3) which slant forwardly and draw outside air in through the opening 71 when the boat is moving forwardly in the direction indicated by the arrow 85 (refer to FIG. 3).

In the deck 31 is formed an opening 75 (FIG. 2) in the area in which the internal combustion engine 56 is mounted. An air channel 74 is formed by mounting the ventilation member 62 to the underside of the deck 48. This air channel 74 is connected to the opening 71 in the gunwale 49 of the deck 31, and it is also connected to the opening 75 formed in the deck 31, thus introducing the air which is guided in from the outside into the engine compartment 60, in which the internal combustion engine 56, etc., are located.

In addition, in the same way, an opening 64*a* is also formed in the outer side of the other gunwale 48, and in this opening 64*a* is mounted a baffle member 65. The baffle member 65 has openings and guide vanes 67*a* which slant rearwardly for discharging to the outside the air from the engine compartment 60 after it has cooled the internal combustion engine when the boat of this invention is moving forwardly in the direction indicated by the arrow 85 in FIG. 3. The ventilation member 61 composed of the ventilation member body 61*a* and the cover member 501 is secured to the underside of the deck 31, thus forming an air channel 70. This air channel 70 is connected to the engine compartment 60 via an opening 68*a* formed in the area in which the internal combustion engine 56 is mounted.

Thus, when the boat is moving forwardly, the air which is taken in through the baffle member 72 is introduced into the engine compartment 60 through the air channel 74, and the air inside the engine compartment 60 is discharged from the air channel 70 via the baffle member 65, thus ventilating the engine compartment 60. The ventilation member 62 preferably has the same composition as the ventilation member 61.

This arrangement has the further advantage that the mounting and securing the ventilation members 61 and 62 to the deck 31 from one gunwale 48 to the other gunwale 49 makes it possible to improve the rigidity and increase the strength of the boat body 30.

Figure 5:
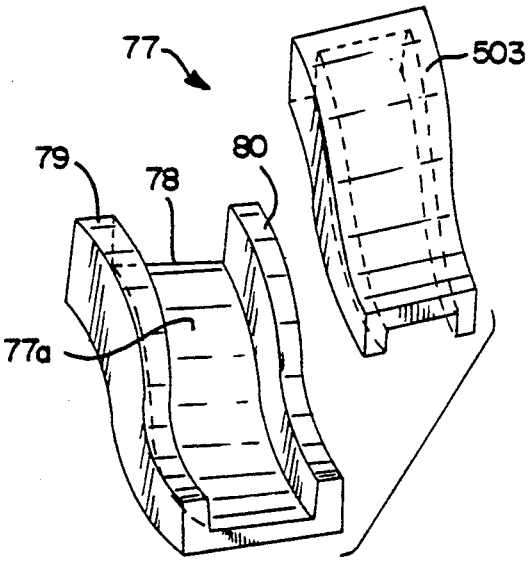
FIG. 5 shows an exploded perspective view of a ventilation member according to another embodiment of this invention.

FIG. 5 shows an exploded perspective view of the ventilation member 77 in an alternative embodiment of this invention. This ventilation member 77 is made of, for example, synthetic resin foam material, and it has a U-shaped channel 78. A cover member 503 is attached with adhesive, etc. to the upper edges 79 and 80 of the ventilation member body 77*a*, and by securing this ventilation member to the underside of the deck 31 in the same way as the ventilation members 61 and 62, it is possible to form an air channel. This ventilation member 77 is preferably fabricated by a molding process.

Note that it is also possible to form the air channel by eliminating the cover members 501 and 503 shown in FIGS. 4 and 5, and mounting either the flanges 67 and 68 of the ventilation member body 61*a*, or the upper edges 79 and 80 of the ventilation member body 77*a*, directly to the underside of the deck 31.

Figure 37:
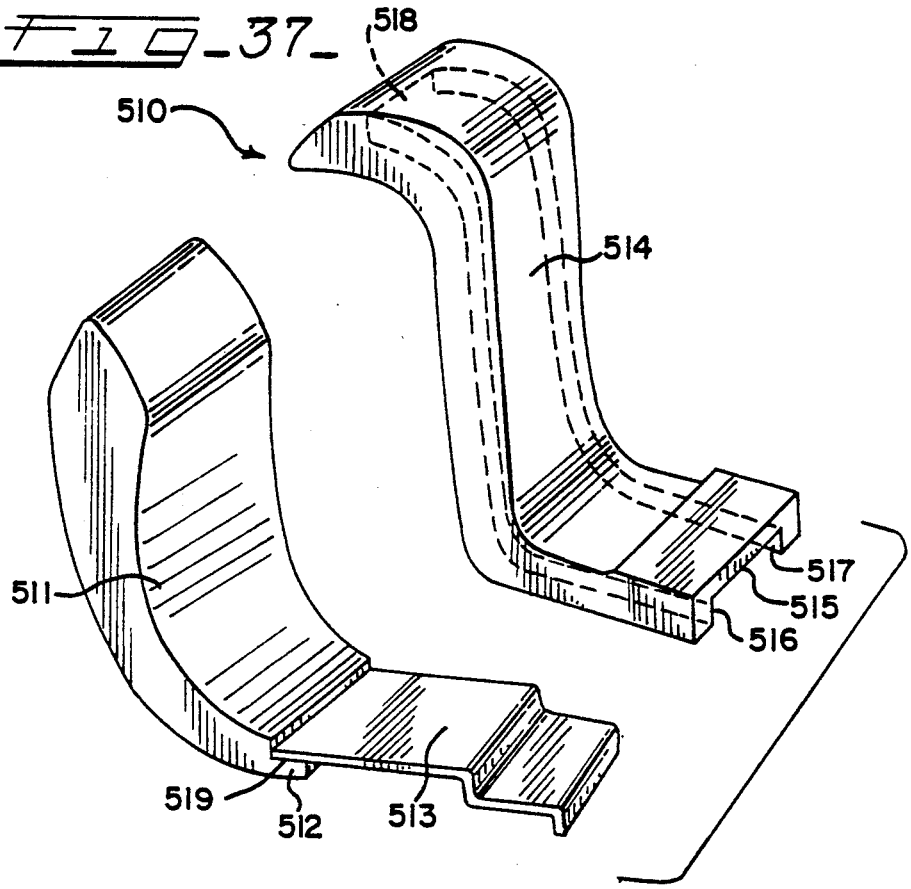
FIG. 37 shows an exploded perspective view of a ventilation member of yet another embodiment of this invention.
Figure 38:
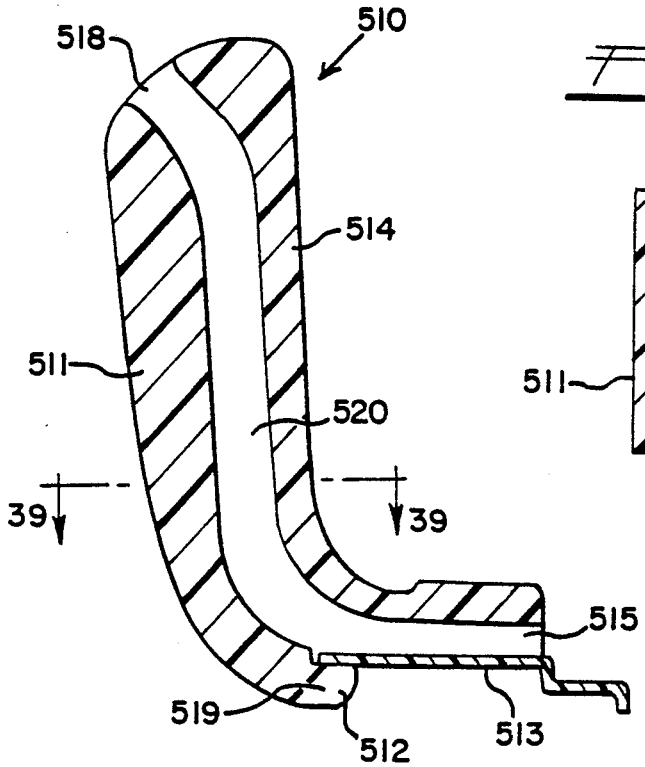
FIG. 38 shows a vertical cross-sectional view of the central area formed when block-shaped member inside a ventilation member and the cover member are assembled together.
Figure 39:
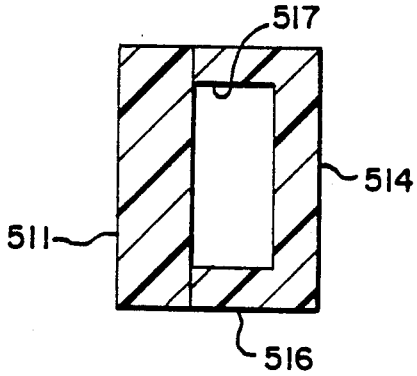
FIG. 39 shows a horizontal cross-sectional view taken along line 39—39 in FIG. 38.

FIG. 37 shows an exploded perspective view of a ventilation member 510 of yet another embodiment of this invention. FIG. 38 shows a vertical cross-sectional view of the central area formed when the block-shaped member 511 inside the ventilation member 510 and the cover member 514 are assembled together, and FIG. 39 shows a horizontal cross-sectional view along line 39—39 of FIG. 38.

This ventilation member 510 is made of, for example, hard synthetic resin foam material, and it comprises the solid block-shaped member 511 and the cover member 514. The block-shaped member 511 is provided with a stepped part 519 at its lower end 512, and a hard resin plate 513 is secured with adhesive, etc., to this stepped part 519. The cover member 514 has channels formed in its underside, and these channels 515 and 518 are formed by the sides 516 and 517 which run continuously along the length of the cover member 514. By securing the ventilation member 510 composed in this way to the underside of the deck 31, just as the previously described ventilation member 61 and 62 (refer to FIGS. 2 and 4), it is possible to form an air channel 520. This ventilation member 510 is preferably fabricated by a molding process.

The spaces 81 and 82 (refer to FIG. 2) between the deck 31 and the hull 32 are filled with a lightweight filler material such as a synthetic resin foam material in order to improve the rigidity of the boat body 30 and also to provide buoyancy. It is also possible to form channels in this filler material, thus forming air channels between the filler material and the underside of the deck 31. Doing this makes it possible to eliminate the ventilation members 61 and 77, thus simplifying the composition of the boat.

Figure 6:
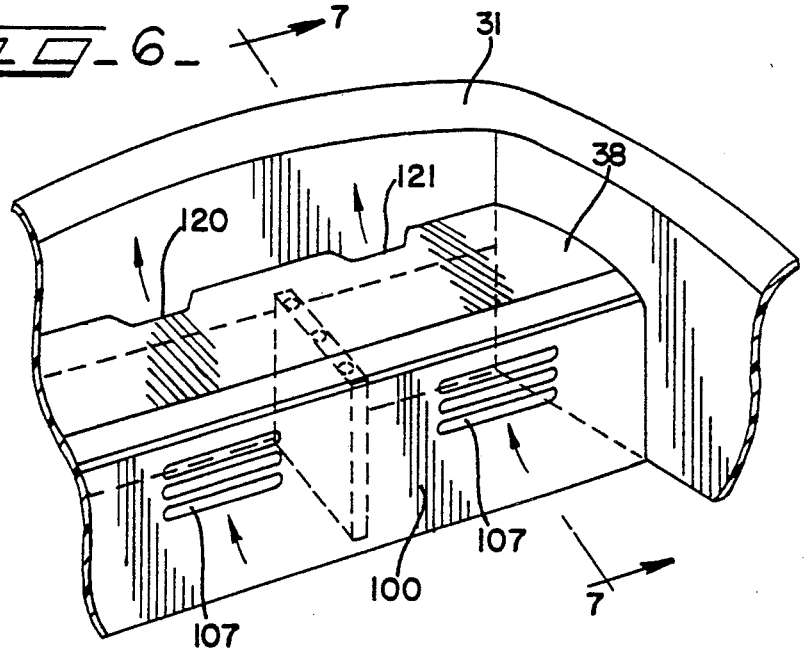
FIG. 6 shows a perspective view of the area of a passenger seat at the rear of the boat.
Figure 7:
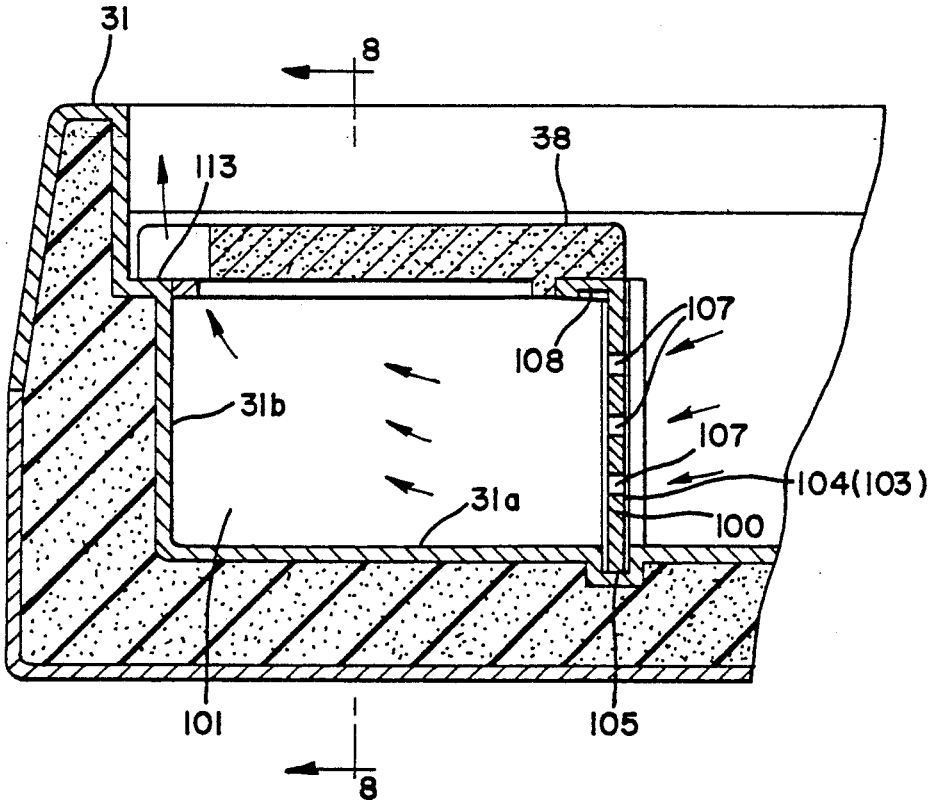
FIG. 7 shows a cross-sectional view taken on the line 7—7 in FIG. 6.

FIG. 6 shows a perspective view of the area of the passenger seat 38 at the rear of the boat, and FIG. 7 shows a cross-sectional view as seen from section line 7—7 in FIG. 6. A storage compartment 101 is formed by a floor part 31*a* and a vertical wall part 31*b* of the deck 31, and a front panel 100 is mounted to the floor part 31*a* of the deck. This storage compartment 101 is open at the top, and the opening is closed by the passenger seat 38, which also acts as a cover, so that it is capable of being opened and closed.

Figure 8:
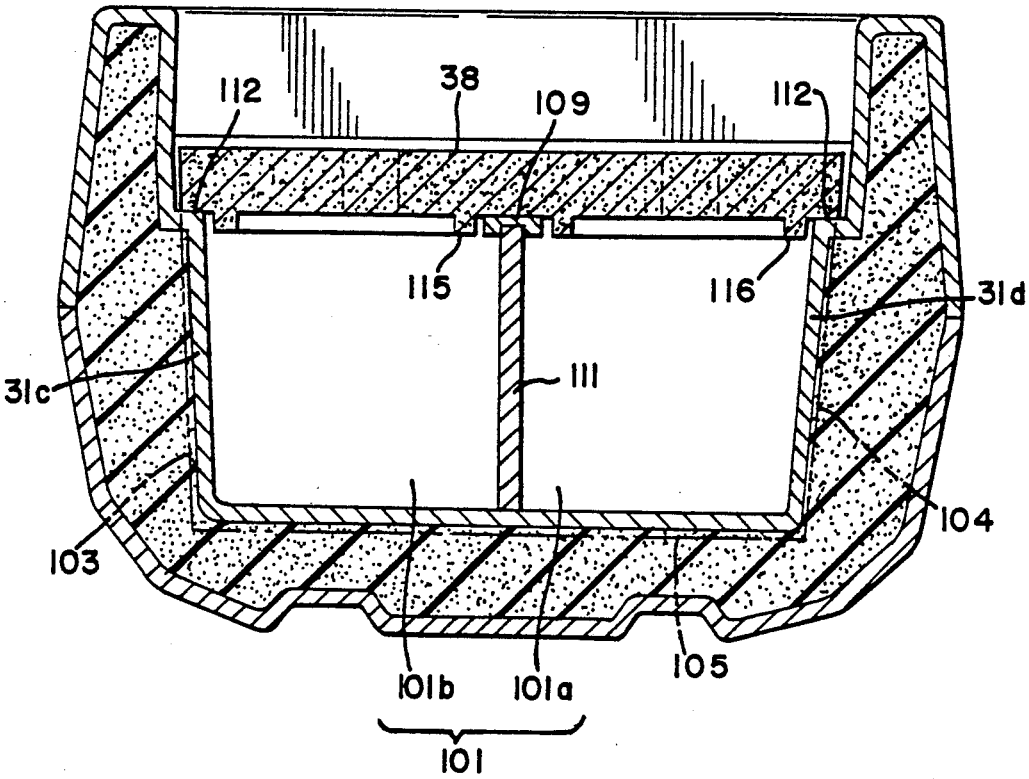
FIG. 8 shows a cross-sectional view taken on the line 8—8 in FIG. 7.
Figure 9:
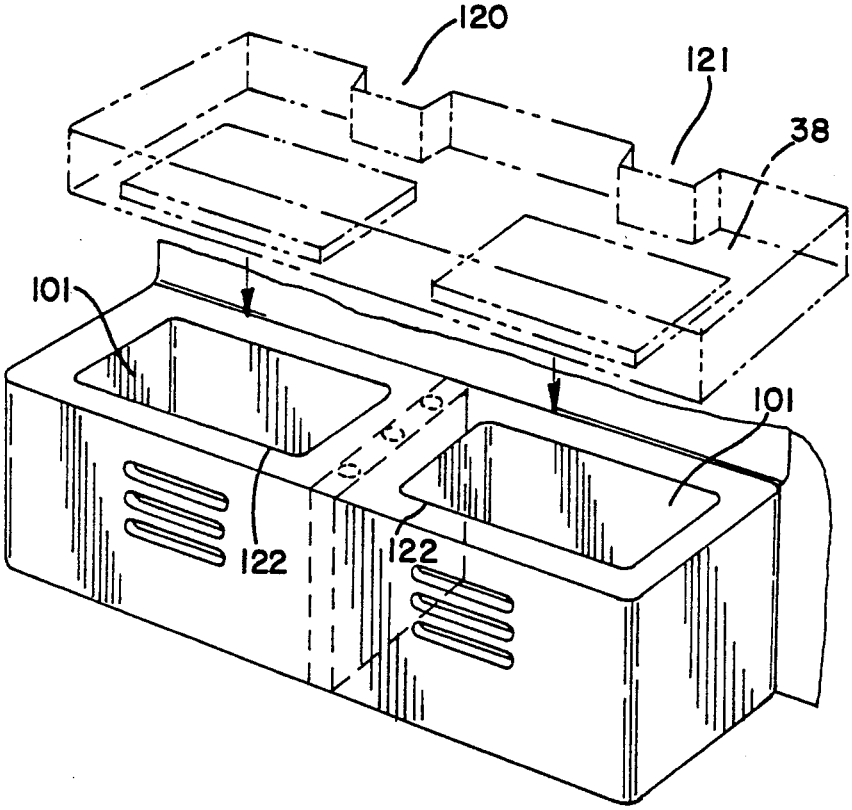
FIG. 9 shows an exploded perspective view of the passenger seat and the surrounding area.
Figure 11:
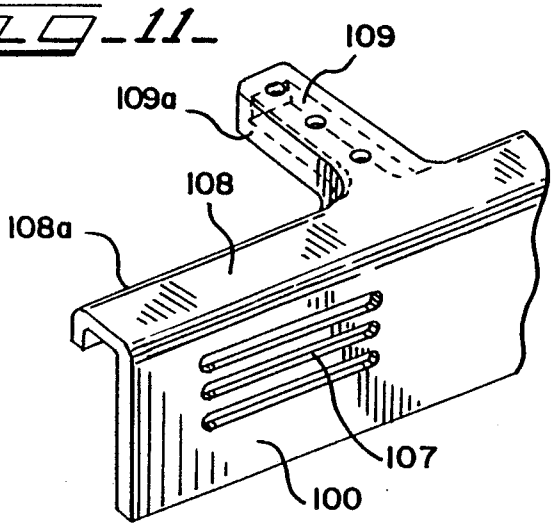
FIGS. 10 and 11 show perspective views of a storage compartment and the surrounding area.
Figure 12:
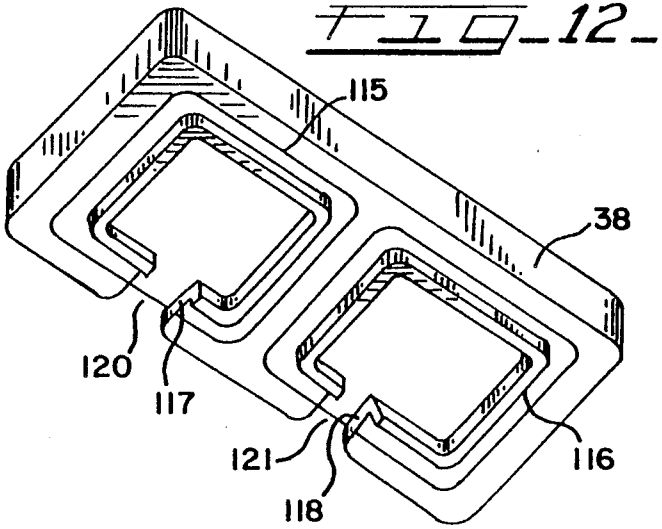
FIG. 12 shows a perspective view as seen from beneath the passenger seat.
Figure 10:
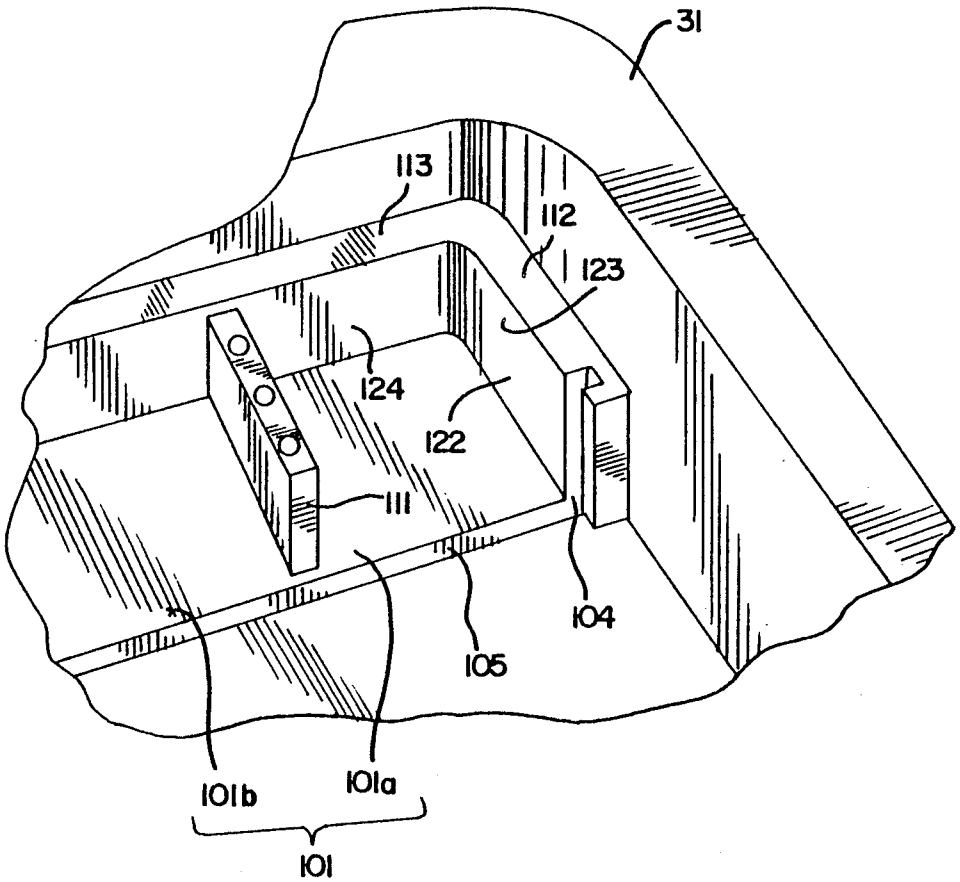

FIG. 8 shows a cross-sectional view as seen from section line 8—8 in FIG. 7, FIG. 9 shows an exploded perspective view of the passenger seat 38 and the surrounding area, FIGS. 10 and 11 show perspective views of the storage compartment 101 and the surrounding area, and FIG. 12 shows a perspective view as seen from beneath the passenger seat 38. Referring to these drawings, engagement grooves 103 and 104 (refer to FIG. 7) are formed in the sides 31*c* and 31*d* of the deck 31, and an engagement groove 105 is formed in the floor part 31*a* of the deck. The outer peripheral edges of the front panel 100 fit precisely into the grooves 103–105.

In the front panel 100 shown in FIG. 7, multiple rectangular air inlets 107 are formed as air inlet holes. IN this front panel 100 are formed a support part 108 extending to the left and right of the boat and a support part 109 (FIG. 8) projecting toward the rear. Inside the storage compartment 101, a partition plate 11 (refer to FIG. 8) is secured with adhesive, etc., to the floor part 31*a* (refer to FIG. 7) and the vertical wall part 31*b* (refer to FIG. 7) of the deck 31. To the upper edge of this partition plate 111, the support part 109, which is formed in one piece with the front panel 100, is secured with screws, etc.

Stepped support parts 112 and 113 are formed at the rear and rear left and right sides, respectively, of the deck 31.

Approximately C-shaped projections 115 and 116 are formed on the underside of the passenger seat 38 in one piece with the seat. Recesses 117 and 118 (FIG. 12) extending toward the rear are also formed on this underside of the seat 38, and these recesses 117 and 118 are connected to outlet holes 120 and 121 formed in the rear part of the seat 38. These outlet holes 120 and 121 are formed as cutouts in the rear part of the seat 38.

The underside of the seat 38 sits on the support parts 108 and 109, which are formed in one piece with the front panel 100, and it also sits on the support parts 112 and 113 of the deck 31. At this time, the projections 115 and 116 are engaged with the openings 122 which open to the top of the storage compartment 101. The outer peripheral surfaces of the projections 115 and 116 fit up against the peripheral edges 108*a* and 109*a* of the support parts 108 and 109, and, by also fitting up against the walls 123 and 124 which are connected to the support parts 112 and 113 of the deck 31, they determine the position of the seat 38.

While the boat is in motion, air enters the storage compartment 101 through the air inlets 107 in the front panel 100, and the air which is inside the storage compartment 101 is discharged from the top of the storage compartment 101 through the outlet holes 120 and 121 (FIG. 6) via the recesses 117 and 118 in the seat 38.

Inside one part 101*a* of the storage compartment 101 is located the storage battery (not shown) for the internal combustion engine 56 (refer to FIG. 2), and inside the other part 101*b* of the storage compartment 101, which is separated by the partition plate 111, is located the fuel tank (not shown) for the engine 56. It is also possible to store other articles inside this storage compartment 101.

Using the ventilation arrangement just described for the storage compartment 101, because the passenger seat 38 also serves as the cover of the storage compartment 101, it is possible to reduce the number of parts. In addition, because it is possible to ventilate the storage compartment 101 without having to do anything to the deck 31, the boat can be easily manufactured and productivity increased. Because it is possible to ventilate the storage compartment 101 without having to do anything to the deck 31 or the hull 32 (refer to FIG. 1), the space between the deck 31 and the hull 32 can be easily and completely filled with the synthetic resin foam filler material without leaving any hollow areas, and this not only allows the rigidity of the boat body 30 to be easily increased, but it also makes it possible to obtain ample buoyancy. The weights of the battery and the fuel tank are also on opposite sides of the center line in order to balance the boat.

The passenger seat 38 can be freely opened and closed by using the outlet holes 120 and 121 as handholds, thus allowing inspection, replacement, and other maintenance of the battery, fuel tank, etc., located inside the storage compartment 101 to be performed easily.

Because the passenger seat 38 is positioned to the rear of the helmseat 34 (refer to FIG. 1), because the internal combustion engine 56 (refer to FIG. 1), etc., is positioned beneath the helmseat 34 as described earlier, and because the battery, fuel tank, etc., are located inside the storage compartment 101 beneath the passenger seat 38, it is easy to balance the weight of the boat body 30 longitudinally, thus providing smooth riding.

Figure 13:
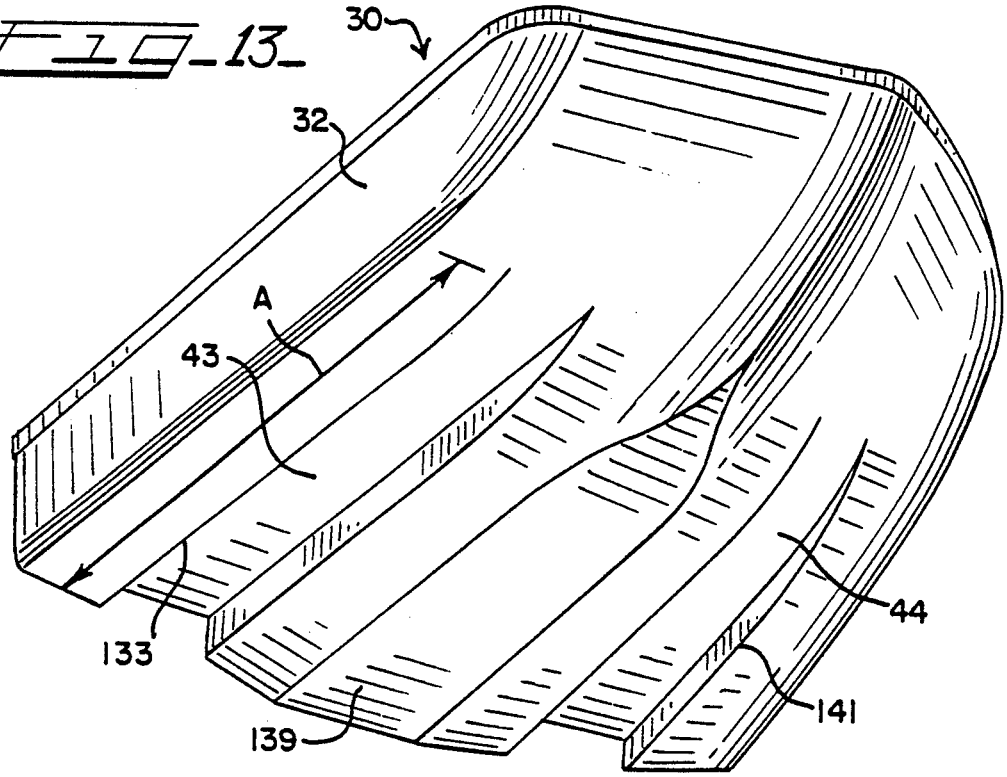
FIG. 13 shows a perspective view of the bottom of the hull part of the boat body.

FIG. 13 shows a perspective view of the bottom of the hull 32 part of the boat body 30. The boat is designed to be symmetrical left and right on opposite sides of the longitudinal center line, and left and right channels 43 and 44 are formed running in the longitudinal direction. The formation of the channels 43 and 44 makes it possible for the boat to move forward without tailsliding, thus improving the boat's straight-ahead travel characteristics. In addition, the formation of the channels 43 and 44 help to prevent the boat from slipping sideways.

Figure 14:
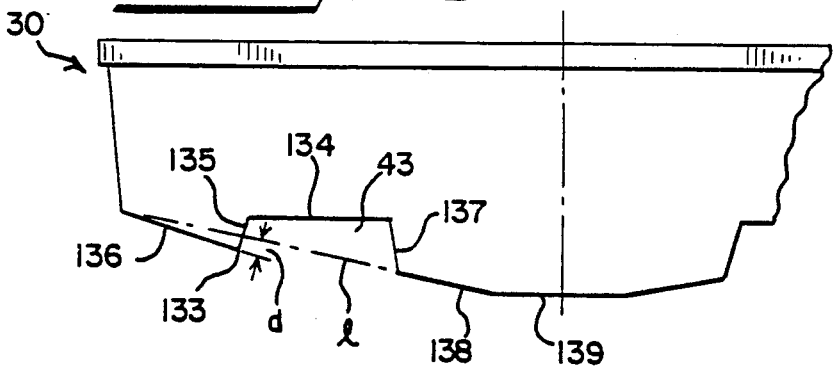
FIG. 14 shows a perspective view showing in more detail the bottom of the hull part of the boat body.

As shown in FIG. 14, the outboard chine 133 of the channel 43 projects farther downward than the extension of the inboard line l of the bottom of the boat. From the top face 134 of the channel 43 to the outboard chine 133, the side face 135 is formed so that it slants downwardly and in the outboard direction, and the bottom part 136 is formed so that it slants from the outboard chine 133 upwardly and in outboard direction of the bottom of the boat. The bottom part 138 is connected to the side face 137, which slants toward the center of the channel 43. Closer to the center than the bottom part 138 is the flat horizontal bottom part 139. The bottom part 138, the channel 43, and the bottom part 136 form the slanted part of the bottom of the boat. The outboard chine 133 of the channel 43 is formed in a V-shape perpendicular to the longitudinal direction of the boat body 30 by the side face 135 and the bottom part 136.

Thus, this composition, in which the outboard part of the channel 43 projects farther downward than the extension of the inboard line l of the bottom of the boat, extends longitudinally along the bottom of the boat within the area indicated by the arrows A in FIG. 13. The other channel 44 is also shaped in the same manner, with the outboard chine 141 of the channel 44 projecting farther downward than the extension of the inboard line of the bottom of the boat.

By this design, it is possible to make it difficult for the boat according to this invention to slip sideways, thus making it possible to help prevent tailsliding and improve the steering characteristics of the boat.

Figure 15:
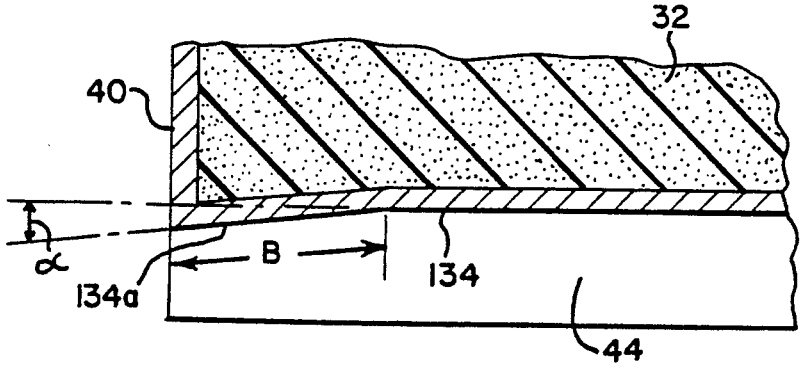
FIG. 15 shows a cross-sectional view of the area of the stern part of the bottom of the hull.

FIG. 15 shows a cross-sectional view through the channel 44 of the area of the stern part 40 of the bottom of the hull 32. The top face 134 of the channel 44 slants downwardly at angle $\alpha$ adjacent the rear of the boat (the left side as seen in FIG. 15) across a range of length B in the longitudinal direction at the edge of the stern 40, and this slanting part is indicated by reference mark 134*a*. The angle $\alpha$ is, for example, approximately 2 to 4 degrees.

By providing this slanting part 134*a* at the stern edge of the top face 134 of the channel 44, it is possible to generate dynamic lift for the stern 40. Usually, with this type of small boat, the combination of such factors as the overall length being relatively short and the center of gravity being distributed toward the rear, there is a tendency for porpoising, or lifting of the bow, to occur. By forming the slanting part 134*a* as described above, it is possible to prevent propoising from occurring and thus allow the boat to begin skimming the water at relatively low speed.

Figure 16:
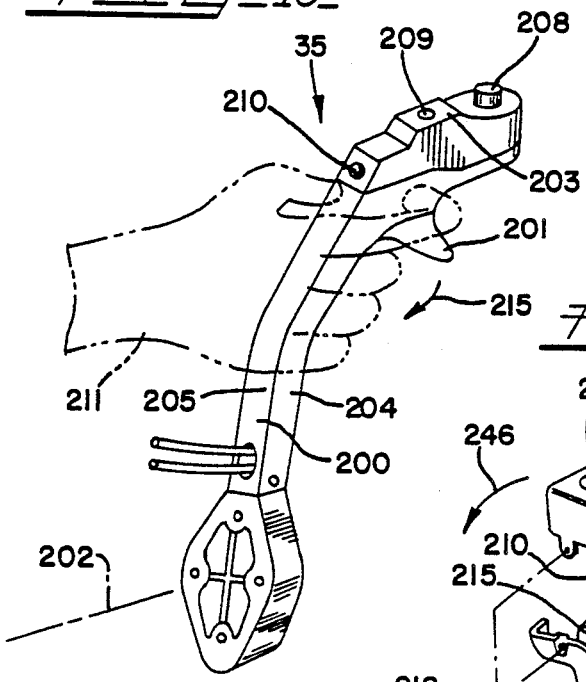
FIG. 16 shows a perspective view of a control stick of the boat.
Figure 17:
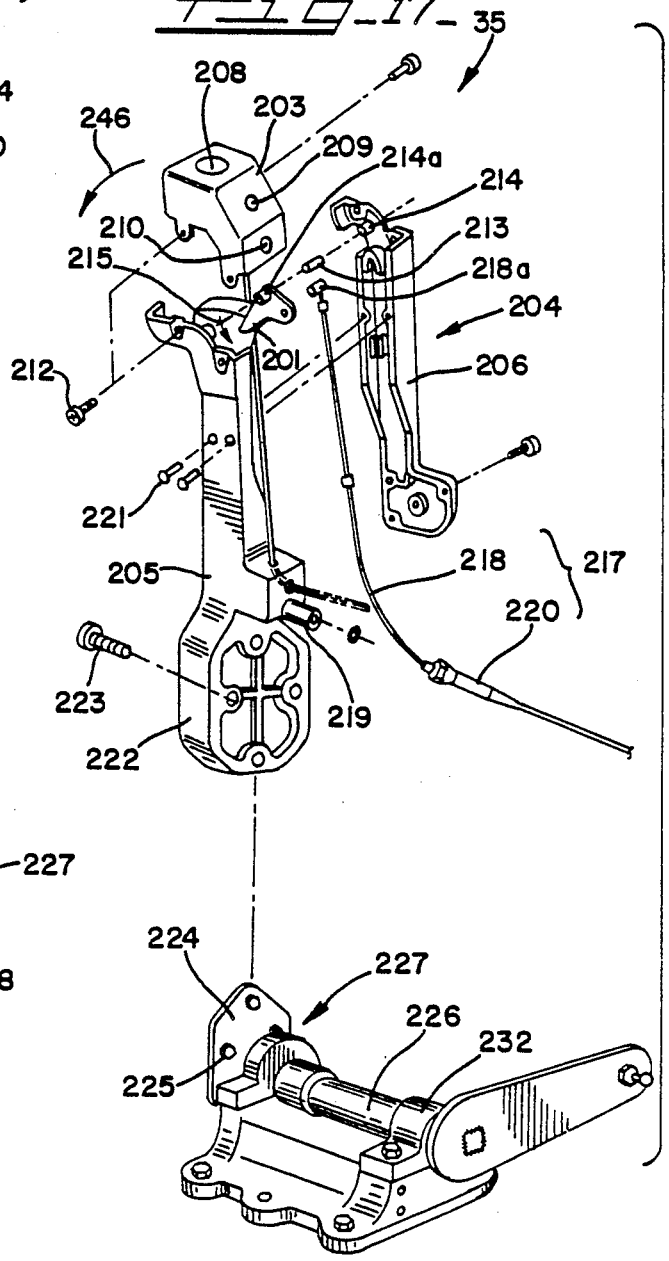
FIG. 17 shows an exploded perspective view of the control stick.

FIG. 16 shows a perspective view of the control, stick 35, and FIG. 17 shows an exploded perspective view of the control stick 35. The control stick 35 basically comprises a stick structure 200 and a trigger or lever 201 which is pivotably mounted on the stick structure 200. By angularly displacing the stick structure 200 in the sideways direction on its rotational axis 202, the nozzle 41 (refer to FIG. 1) located at the stern 40 (refer to FIG. 1) is angularly displaced left and right with respect to its vertical axis, thus changing the direction of the jet propulsion and the boat.

The rotational axis 202 of this stick structure 200 is parallel to the longitudinal direction or axis of the boat. The purpose of the lever 201 is to accelerate or decelerate the internal combustion engine and thereby adjust the propulsion force, and it is capable of being angularly displaced toward and away from the stick structure 200. The stick structure 200 has a switch mounting 203 on its upper end and a body 204 to which this switch mounting 203 is secured. The body 204 has a base 205 and a cover 206 which is secured to the base 205.

The top of the stick structure 200 is curved toward the front of the boat (toward the right side of FIG. 16), and it is formed approximately in a reverse-L shape. A main electric switch 208, an on-switch 209 for starting the engine, and an off-switch 210 for shutting down the engine are arranged in that order from the front toward the rear with intervals between them on the top of the switch mounting 203. The main switch 208, the on-switch 209, and the off-switch 210 are in the present example, all pushbutton switches The purpose of the main switch 208 is to connect electrical power from the battery to the electrical system of the internal combustion engine, the on-switch 209 functions to supply electrical power to the starter motor which starts the internal combustion engine 56 (refer to FIG. 2), and the off-switch 210 functions to disconnect the supply of electrical power to the spark ignition circuit of the internal combustion engine 56 (refer to FIG. 2).

The driver sits in the helmseat 34 (refer to FIG. 1), grips the body 204 of the stick structure 200 in one hand 211, and uses the index finger of that hand to angularly displace the lever 201 and adjust the propulsion force. The off-switch 210 can be operated with the thumb of that hand 211 in order to stop the engine 56.

By angularly displacing the lever 201 toward or away from the stick structure 200, the opening of the throttle valve of the engine carburetor (refer to FIG. 2) can be adjusted, thus allowing the propulsion force to be adjusted as described above.

In FIG. 17, the switch mounting 203 is secured to the top part of the body 204 with bolts 212. In the cover 206 of the body 204, a pin 213 is press fit into a fastening projection 214. This pin 213 is inserted through the hole 214*a* for the mounting of the lever 201, thus making it possible for the lever 201 to be angularly displaced around the axis of the pin 213 in the direction indicated by the arrow 215 and in the opposite direction. Inside the body 204, the end 218*a* of the inner cable 218 of the throttle cable 217 is secured to the lever 201. The inner cable 218 is loosely inserted from the inside of the body 204 through a tube 219 in the base 205. The end of the outer cable 220 of the throttle cable 217 is secured to this tube 219. The base 205 and the cover 206 which comprise the body 204 are secured together in one piece by bolts 221.

Bolts 223 are inserted through the mounting 222 of the base 205 and secured to a flange 224. Nuts 225 are secured to this flange 224, and the bolts 223 are screwed into these nuts. A shaft 226 is secured to the flange 224. This shaft 226 is supported by a slide bearing 227.

Figure 18:
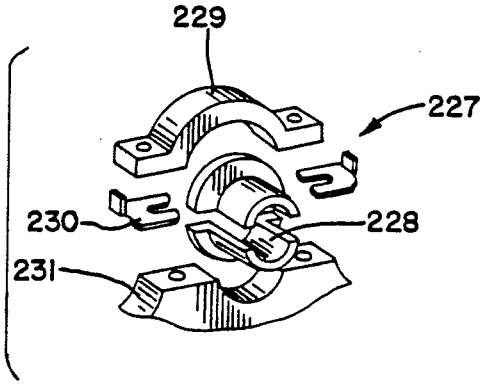
FIG. 18 shows an exploded perspective view of a slide bearing of the control stick.

FIG. 18 shows an exploded perspective view of the slide bearing 227. The shaft 226 (refer to FIG. 17) is encased by a bushing 228, and it is mounted via two shims 230 to a base 231 by a holder 229. The shaft 226 (refer to FIG. 17) is also supported on the base 231 by the slide bearing 232 (refer to FIG. 17).

Figure 19:
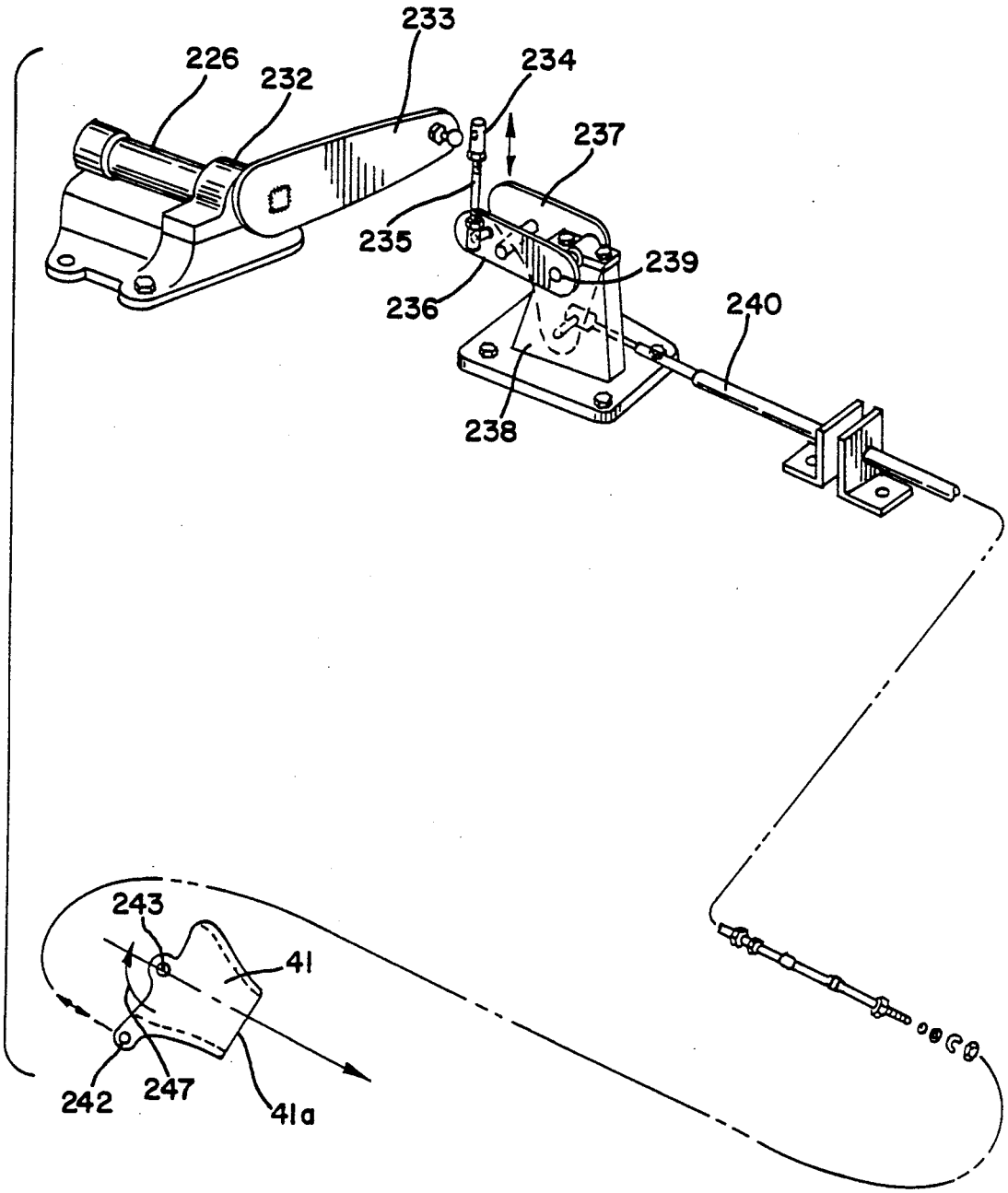
FIG. 19 shows a perspective view of a mechanism for the steering of the boat by the angular displacement of a jet nozzle according to the operation of the control stick.

FIG. 19 shows a perspective view of the mechanism for the steering of the boat by the angular displacement of the nozzle 41 (FIG. 1) via the operation of the control stick 35. An arm 233 is secured to the shaft 226. The end of this arm 233 is connected to another arm 236 via a ball joint or spherical bearing 234 and a rod 235. This arm 236 is secured to yet another arm 237. The arms 236 and 237 are supported on a bracket 238 so that they are capable of being angularly displaced around the shaft 239. The arm 237 is secured to one end of a steering cable 240, and the other end of the steering cable 240 is connected to the side end 242 of the nozzle 41. The nozzle 41 is mounted to the stern part 40 (refer to FIG. 1) of the boat body 30 via a pin or other nozzle shaft support member 243. The axial line of the pin or other nozzle shaft support member 243 extends vertically so that the nozzle can pivot on a vertical axis.

Referring to FIGS. 16 and 19, by operating the lever 201 during the operation of the boat, the opening of the throttle valve of the carburetor of the internal combustion engine is adjusted via the throttle cable 217 (FIG. 17). By angularly displacing the lever 201 by a large angle in the direction indicated by the arrow 215, the opening of the carburetor of the internal combustion engine is increasingly opened in accordance with the amount of angular displacement of the lever 201.

The internal combustion engine drives a water jet pump connected to the nozzle, and this water jet pump discharges water under pressure from the nozzle 41, thus providing the propulsion force.

By angularly displacing the control stick 35 and thus causing the shaft 226 to be angularly displaced around its axis 202 (refer to FIG. 16), arms 233, 236, and 237 are angularly displaced, and thus the steering cable 240 causes the nozzle 41 to be angularly displaced around the pin or other nozzle shaft support member 243. When the driver sitting in the helmseat 34 (refer to FIG. 1) operates the control stick 35, for example, angularly displacing it in the direction indicated by the arrow 247 (see FIG. 19), the jet outlet 41*a* of the nozzle 41 at the stern 40 is angularly displaced around the axis of the pin 243 in the direction indicated by the arrow 247, thus causing the bow of the boat to turn to the left. In this way, the boat can be turned.

When the axial line of the base 205 (FIG. 17) of the stick is vertical, the axial line of the nozzle 41 extends in the longitudinal direction of the boat body 30, and the boat will move straight ahead. The nozzle 41 is angularly displaced around the pin or other nozzle shaft support member 243 only by that angle which corresponds to the amount of angular displacement of the control stick 35. Thus, by observing the direction and amount of the angular displacement of the control stick 35, it is possible to know the turning direction and turning radius of the boat. Because steering is accomplished by the angular displacement of the stick structure 200, there is no need for the large amount of space which is required when using a circular steering wheel such as in the prior art, and the range of movement of the one arm of the driver required to steer the boat is small.

Figure 20:
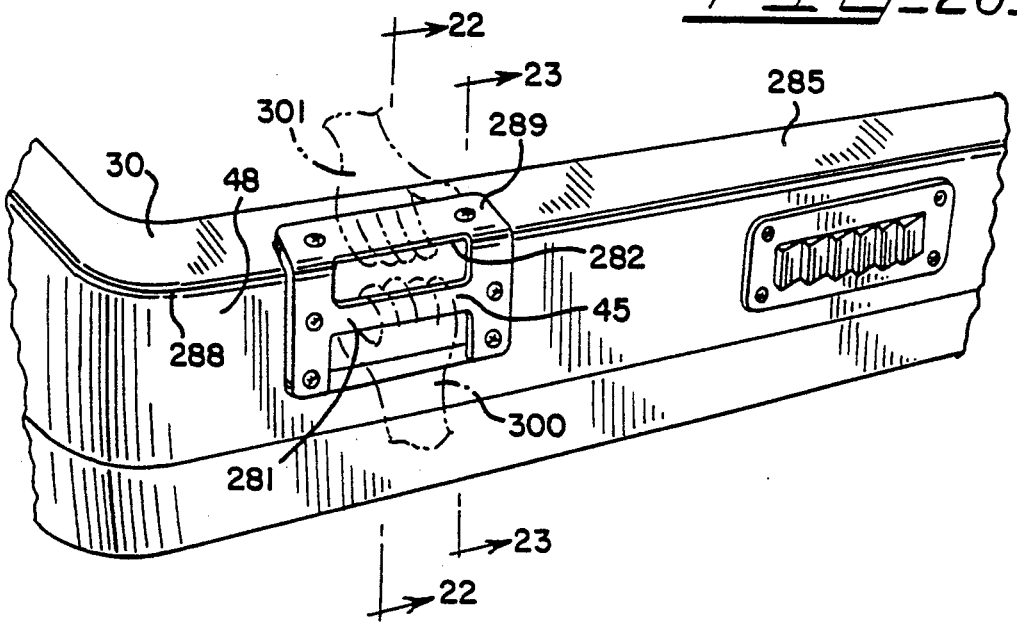
FIG. 20 shows a perspective view of a handle and the surrounding area of the boat.
Figure 21:
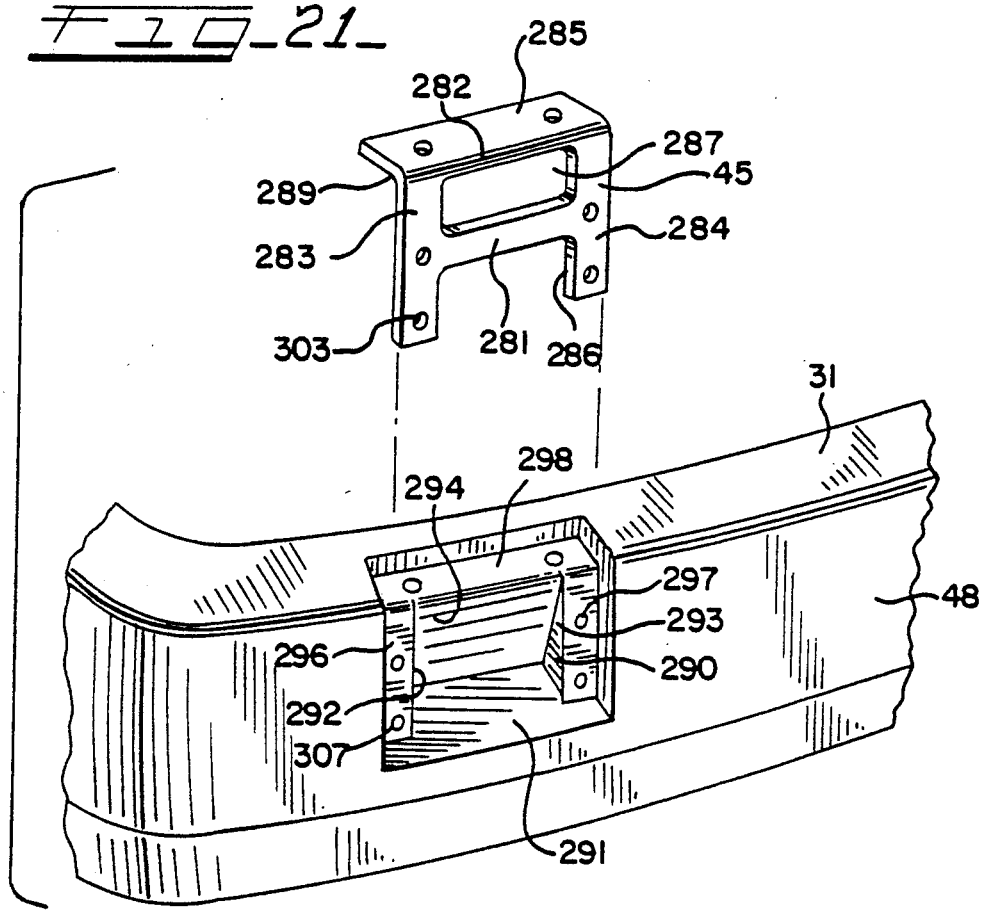
FIG. 21 shows an exploded perspective view of the handle and the surrounding area.

FIG. 20 shows a perspective view of one of the handles 45 and the surrounding area, and FIG. 21 shows an exploded perspective view of one of the handles 45 and the surrounding area. The handles 45 are secured to the upper outside of the deck 48 of the boat body 30. The handle 45 basically consists of the handholds 281 and 282, the mountings 283 and 284 which connect these handholds 281 and 282, and the mounting 285, which is a continuous part of the handhold 282. A cutout 286 and a through-hole 287 are provided in the handhold 281. In the area of the handhold 282 of the handle 45, there is a curved part 289 which is curved along the corner 288 of the deck 31 which forms the gunwale 48.

Recesses 290 are formed in the outer side of the gunwale 48 of the deck 31. Each recess 290 comprises a bottom 291, sides 292 and 293, and a vertical wall 294. Stepped handle mounting surfaces 296, 297, and 298 are formed in the outer periphery of the recess 290.

Figure 22:
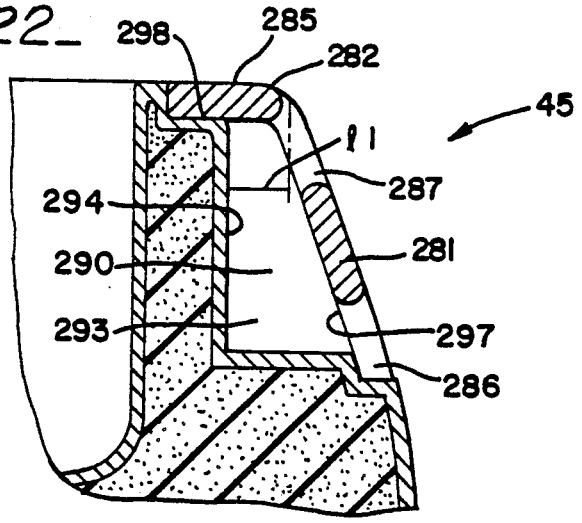
FIG. 22 is an enlarged cross-sectional view taken on the line 22—22 in FIG. 20.
Figure 23:
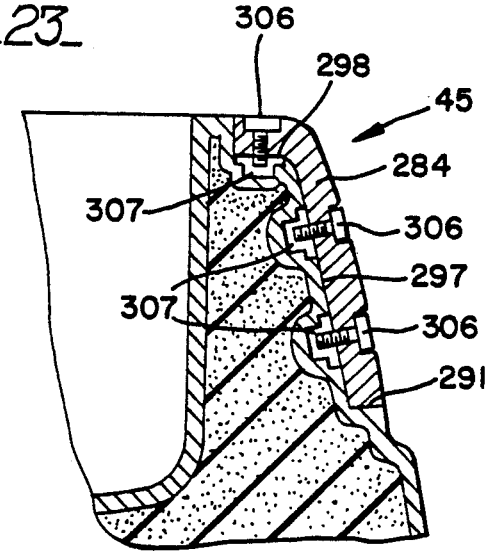
FIG. 23 is an enlarged cross-sectional view taken on the line 23—23 in FIG. 20.

FIG. 22 shows a cross-sectional view as seen from section line 22-22 in FIG. 20, and FIG. 23 shows a cross-sectional view as seen from section line 23-23 in FIG. 20. Because there is the cutout 286 below the handhold 281 and the through-hole 287 between the handhold 281 and the other handhold 282, the handhold 281 can be grasped as indicated by the imaginary hand 300 in FIG. 20. This allows a person in the water to grasp the handhold and climb into the small boat.

As clearly shown in FIG. 22, the upper end of the handhold 282 projects the length l l from the vertical wall 294 of the recess 290. Thus, a person riding in the small boat can grasp the handhold 282 as indicated by the imaginary hand 301 in FIG. 20 for support.

A rope can also be wound around the handhold 281 in order to moor the boat.

Because the outer peripheral surfaces of the handles 45 are flush with the outer peripheral surfaces of the gunwale 48 of the deck 31 and do not protrude outwardly, the handles 45 do not present an obstacle to the boarding or deboarding of the boat, and passengers can get in and out easily In addition, the handles 45 will not strike against objects such as when approaching the shore, thus preventing the handles 45 from being damaged. Moreover, packing and transporting of the boat can be accomplished easily.

Figure 24:
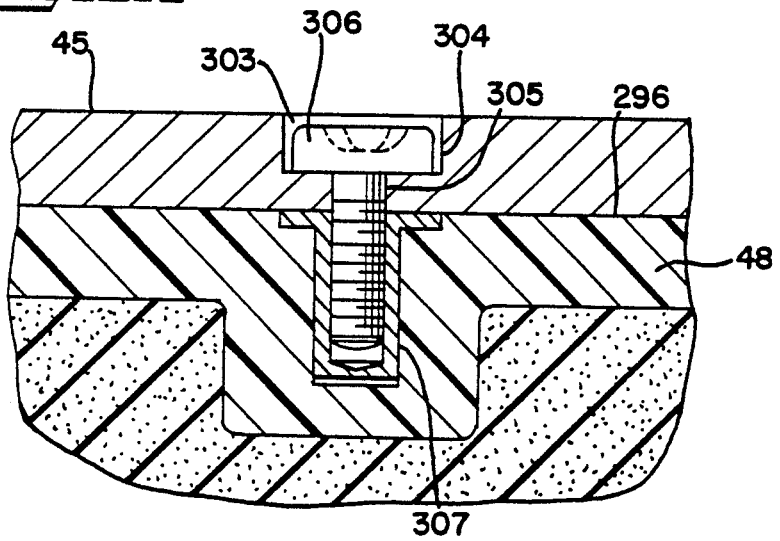
FIG. 24 shows a cross-sectional view of the mounting of a handle.

Mounting holes 303 are formed in the mounting 283 (refer to FIG. 21) of the handle 45. As shown in FIG. 24, these mounting holes 303 have a large-diameter section 304 and small-diameter section 305. Into these mounting holes 303 are inserted the mounting bolts 306. Nuts 307 are insert-molded in the boat so that they are embedded in the gunwale 48 facing the mounting surface 296. By screwing the bolts 306 into the nuts 307, the handle 45 is secured to the gunwale 48. The heads of the bolts 306 do not protrude outwardly from the surface of the handle 45 (see FIG. 24).

The handles 46 shown in FIG. 2 have the same composition as the handles 45 just described, and they are provided toward the bow 50.

FIG. 25 shows a perspective view of one of the handles 47 provided in the area of the bow 50 of the boat body 30 shown in FIG. 1, and FIG. 26 shows an exploded perspective view of that handle. The handle 47 has a handhold 320 and mountings 321 and 322 which are connected to this handhold 320 on each side of the handhold 320, and cutouts 323 and 324 are formed on each side of the handhold 320. Thus, the overall shape of this handle 47 is an H shape.

Recesses 326 are formed in the bow 50. Each of these recesses 326 comprises a bottom 327, and vertical walls 328 and sides 329 and 330 which are connected to this bottom 327. Mounting surfaces 331 and 332 are formed on the boat body 30 (refer to FIG. 1) leading to the recess 326. The mountings 321 and 322 of the handle 47 are secured to these mounting surfaces 331 and 332 by screwing the bolts 334 into the nuts 335 which face the mounting surfaces 331 and 332 in the same way as the composition in FIG. 24 which has already been described.

Figure 27:
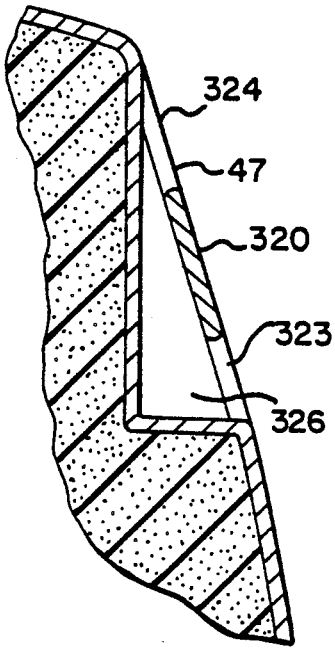
FIG. 27 shows a cross-sectional view taken on the line 27—27 in FIG. 25.
Figure 28:
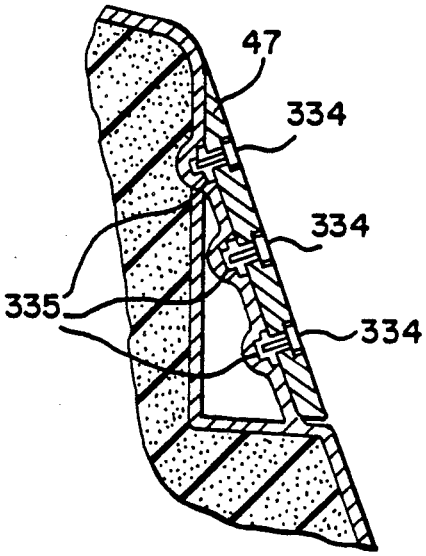
FIG. 28 shows a cross-sectional view taken on the line 28—28 in FIG. 25.

FIG. 27 shows a cross-sectional view as seen from section line 27—27 in FIG. 25, and FIG. 28 shows a cross-sectional view as seen from section line 28—28 in FIG. 25. Referring to these drawings, the handhold 320 of the handle 47 partially covers the recess 326. The handhold 320 is useful for someone swimming outside the boat to grasp, and a rope can also be attached to the handhold 320 in order to moor the boat. Because the handle 47 is flush with the surface of the bow 50 without protruding outwardly from the boat body 30 (refer to FIG. 1), boarding and deboarding of the boat is easy, and packing and transporting of the boat is also easily accomplished.

Figure 29:
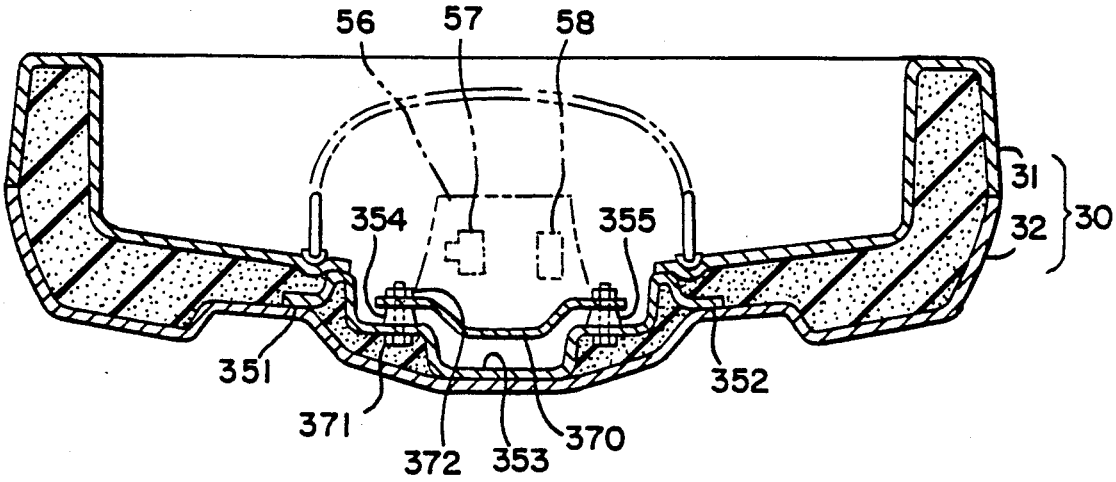
FIG. 29 shows a cross-sectional view of the boat body in the area of the internal combustion engine.

FIG. 29 shows a cross-sectional view of the boat body 30 in the area of the internal combustion engine 56. Mountings 351 and 352 are formed in the hull 32 which comprises the boat body 30, and a support member 353 is secured to these mountings 351 and 352. On this support member 353, via the buffer members 354 and 355, the engine mounting member 370 is secured by bolts 371 and nuts 372. To this engine mounting member 370 is secured the internal combustion engine 56 and related components such as the carburetor 47 and the muffler 58.

Figure 30:
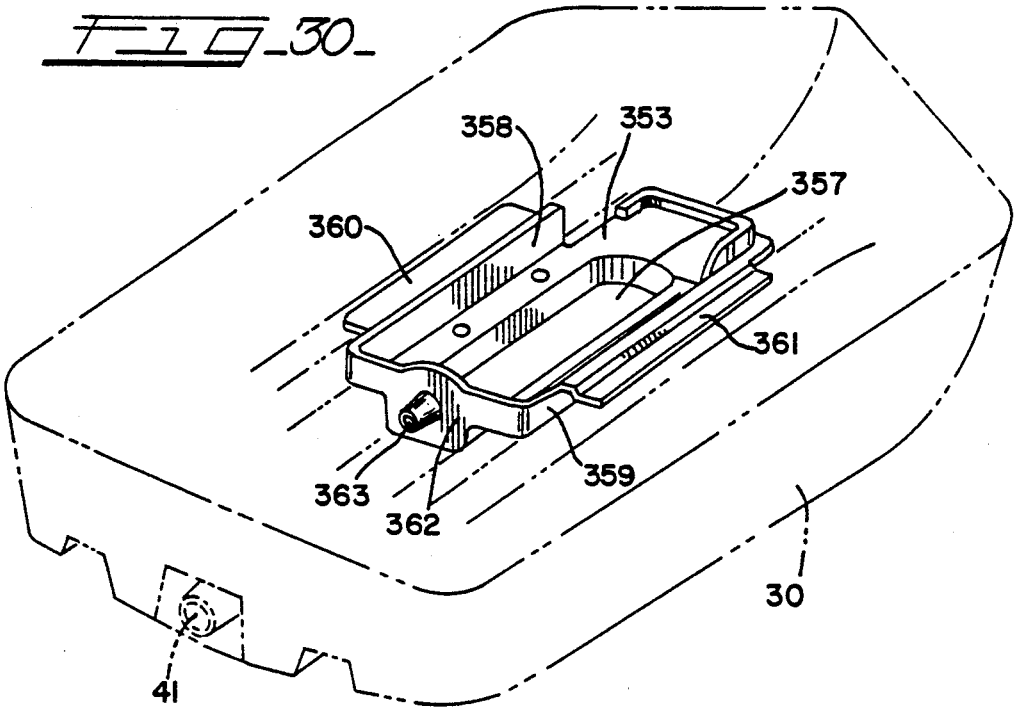
FIG. 30 shows a simplified perspective view partially in phantom lines of the boat body with an engine support member mounted to it.

FIG. 30 shows a simplified perspective view of the boat body 30 with the support member 353 mounted to it. The support member 353 comprises a bottom plate 357, side walls 358 and 359 formed on each side of the bottom plate 357, mounting pieces 360 and 361 which project outwardly from the side walls 358 and 359, and a watertight bulkhead 362 provided at the rear which is connected to the bottom plate 357 and the side walls 358 and 359. In the watertight bulkhead 362 is formed a through-hole 363 through which the output shaft 364 (FIG. 31) of the internal combustion engine 56 (FIG. 29) is passed.

Figure 31:
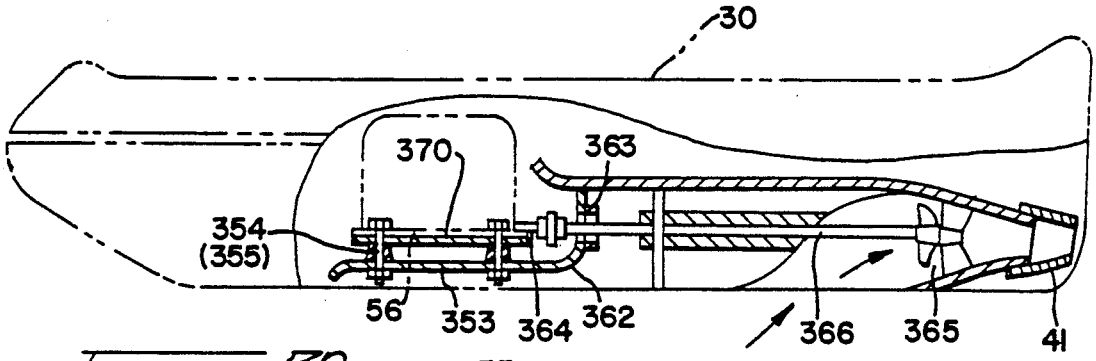
FIG. 31 shows a left-side view partially in section of the boat body 30.

FIG. 31 shows a left-side cross-sectional view of a part of the boat body 30 in the area of the watertight bulkhead 362. The output shaft 364 of the engine 56 passes through the through-hole 363 formed in the watertight bulkhead 362, and this output shaft 364 is connected via a shaft coupling to the input shaft 366 of a propeller pump 365 located toward the rear of the boat body 30. The pump 365 draws in water from the bottom of the boat and discharges that water under pressure from the movable nozzle 41, thus providing jet propulsion.

As mentioned earlier, the internal combustion engine 56, carburetor 57, muffler 58, etc. are mounted on the engine mounting member 370. This assembly work can be done outside of the boat body 30 by removing the engine mounting member 370 from the boat body 30, thus allowing the assembly work to be accomplished easily. Moreover, for inspection and maintenance, because the engine mounting member 370 can be removed from the boat body 30 for the adjustment of the internal combustion engine 56, carburetor 57, muffler 58, and other auxiliary devices of the engine not shown in the drawings, the inspection and maintenance work can be accomplished extremely easily.

Figure 32:
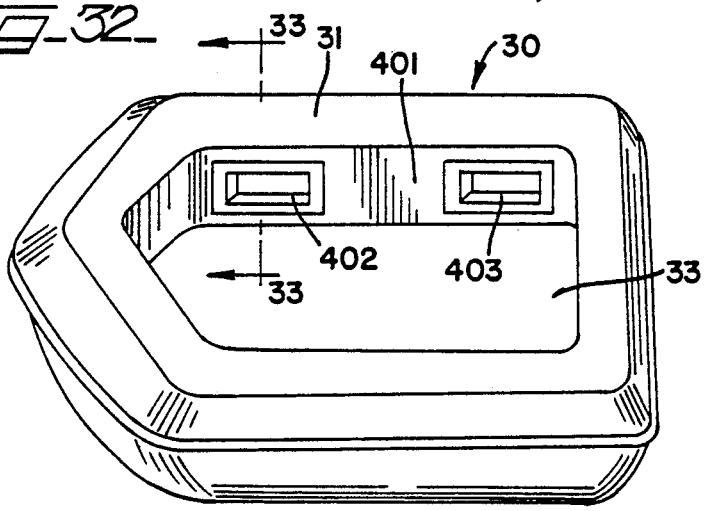
FIG. 32 shows a simplified perspective view of the boat body.

FIG. 32 shows a simplified perspective view of the boat body 30. In the side 401 of the deck 31 which faces the passenger compartment 33 are provided recesses 402 and 403 for the storage of small articles.

Figure 33:
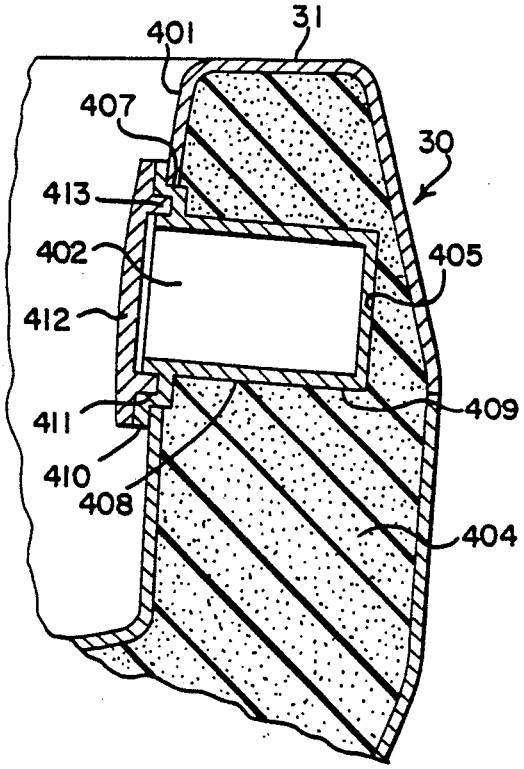
FIG. 33 shows an enlarged cross-sectional view taken on the line 33—33 in FIG. 32.

FIG. 33 shows a cross-sectional view of the area of the recess 402 as seen from section line 33—33 in FIG. 32. The space formed between the deck 31 and the hull 32 which form the boat body 30 is filled with a filler material 404 such as a synthetic resin foam or similar buoyant material, thus improving the rigidity of the boat body 30 and also providing buoyancy. A mounting recess 405 is formed in this filler material 404, and this mounting recess 405 faces an opening 407 formed in the side 401 of the deck 31. Inside the mounting recess 405 is positioned the body 409 of a container 408 (refer to FIG. 34). This container 408 has a flange 410 which is connected to the body 409 and which projects outwardly. An engagement groove 411 which faces outwardly is formed in the flange 410 around the entire circumference of the body 409. Into this engagement groove 411 is connected a circular projection 413 of a cap 412 so that the connection is watertight. Using this cap 412, the recess 402 can be closed so that it is watertight. Inside this recess 402 may be stored such small articles as a fire extinguisher, a flashlight, rope for mooring the boat, an anchor, etc., and it is also possible to store valuables such as a boating license, etc.

Figure 34:
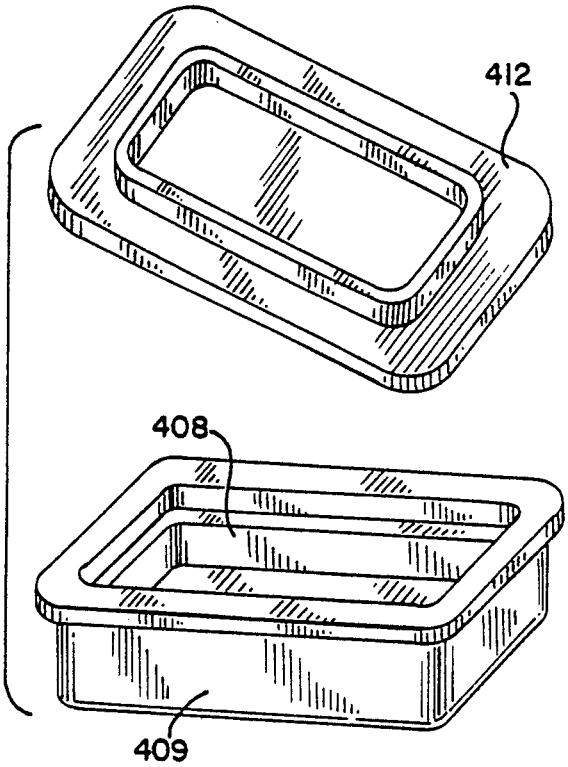
FIG. 34 shows an exploded perspective view of a cap and a container of the boat.

FIG. 34 shows an exploded perspective view of a cap 412 and a container 408, and it is also possible to design the cap 412 so that it can be locked (not shown in the drawings) to the container 408.

The recess 403 is designed in the same way as the recess 402, and the same type of storage areas are also provided in the other side of the deck 31.

Figure 35:
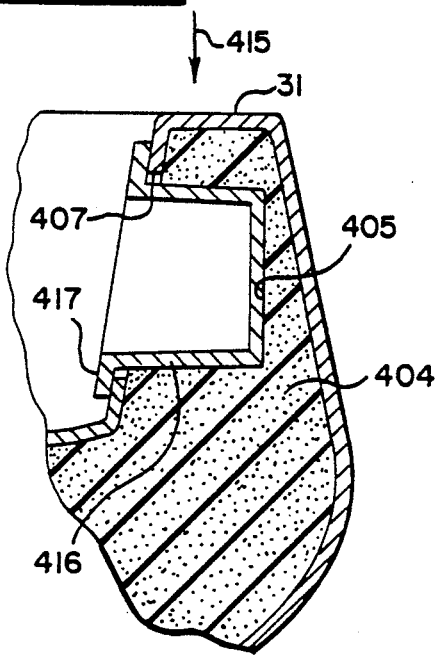
FIG. 35 shows a cross-sectional view of a storage area according to another embodiment of this invention.

FIG. 35 shows a cross-sectional view of the storage area 415 of another embodiment of this invention. In this embodiment, the container 416 is placed into a recess 405 in the filler material 404, and the flange which projects outwardly from the container 416 overlies the area around the opening 407 in the deck 31. With this type of construction, there is no cap provided, thus resulting in a simpler composition.

Figure 36:
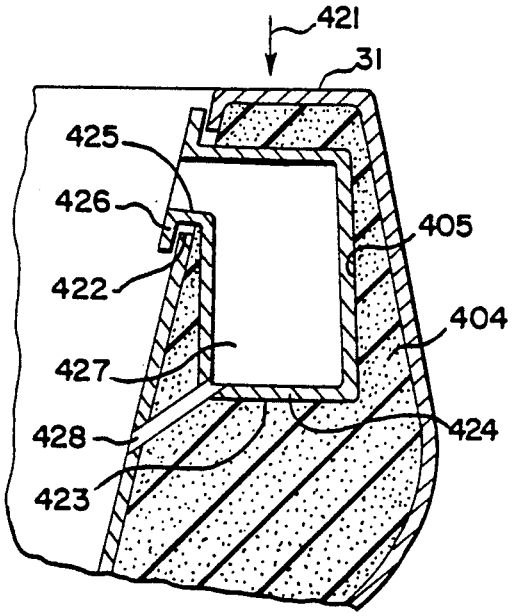
FIG. 36 shows a cross-sectional view of a storage area of yet another embodiment of this invention.

FIG. 36 shows a cross-sectional view of the storage area 421 of yet another embodiment of this invention. An opening 422 is formed in the side of the deck 31, and the body 424 of the container 423 is positioned in the recess 405 formed in the filler material 404. A hooked part 425 is connected to the upper part of the body 424, and a flange 426 is formed on this hooked part 425 facing outwardly. The flange 426 covers the area around the opening 427. In this way, the recess 427 is formed in the side of the deck 31.

If there is danger that water will enter into the recess 427 and accumulate, it is also possible to form a water drainhole 428 in the bottom of the body 424 of the container 423, and it is also possible to provide a cover.

Figure 40:
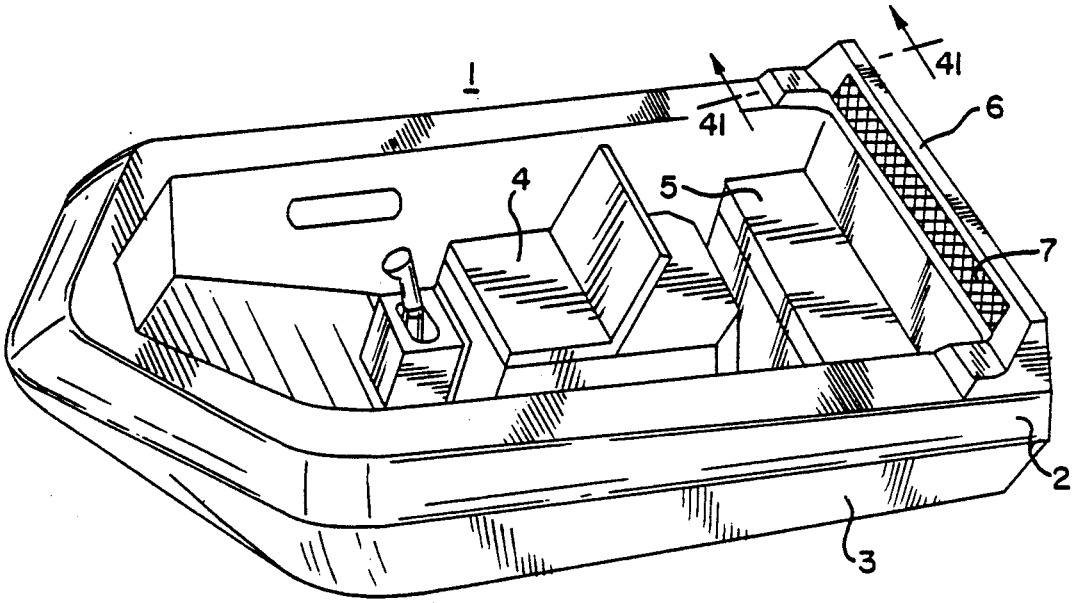
FIG. 40 shows a perspective view of another embodiment of a small boat according to the invention.

In the alternative embodiment of the invention show in FIG. 40, a helmseat 4 and a rear passenger seat 5 are mounted in a boat 1.

The backrest 6 of this invention is mounted to the part of the deck 2 of the boat which faces the passenger seat 5, and there is a sheet 7 on the surface of the backrest 6 which faces the inside of the boat.

The sheet 7 not only acts as a cushion for the persons sitting in the passenger seat, it also functions as a closure for the opening of the storage compartment. Note that the numeral 3 is the hull of the boat.

Figure 41:
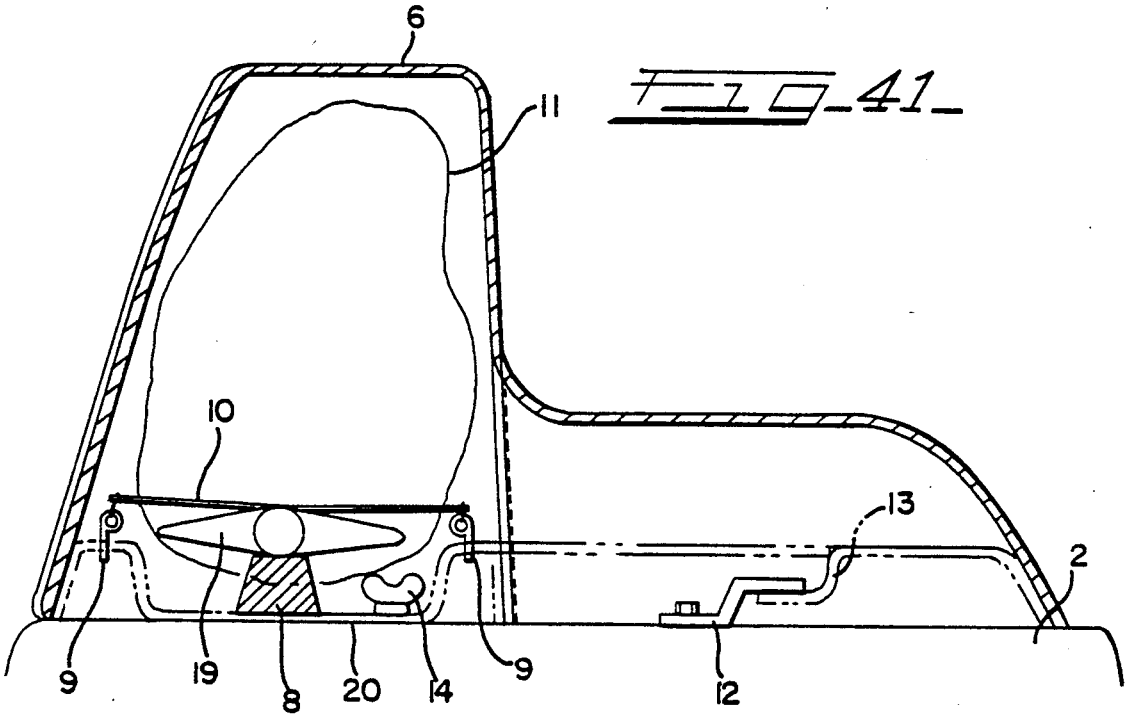
FIG. 41 shows a cross-sectional view along line 41—41 in FIG. 40.

As shown in the cross-sectional view of the backrest 6 and the condition in which it is mounted to the deck 2 in FIG. 41, the backrest 6 is secured to the deck 2 by the securing of the bottom plate 20 with the wing bolts 14, and a storage compartment 11 is formed in the space inside the backrest 6.

Inside this storage compartment 11, securing bands 10 are attached to band hooks 9 which are provided on the bottom plate 20, thus making it possible to secure the boat accessories (small articles) 19.

Note that numeral 8 indicates either a damper for the boat accessories or a bracket for securing them down.

The mounting of the backrest 6 to the deck 2 is as shown in FIG. 41. There are notches 13 provided on the bottom plate 20 of the backrest to correspond to the backrest mounting hooks 12 which are provided on the top of the gunwales on each side of the deck, and by fitting these notches into the mounting hooks 12, the position of the backrest 6 is aligned on the deck 2, and then the bottom plate 20 is secured to the deck 2 with the wing bolts 14.

Figure 42:
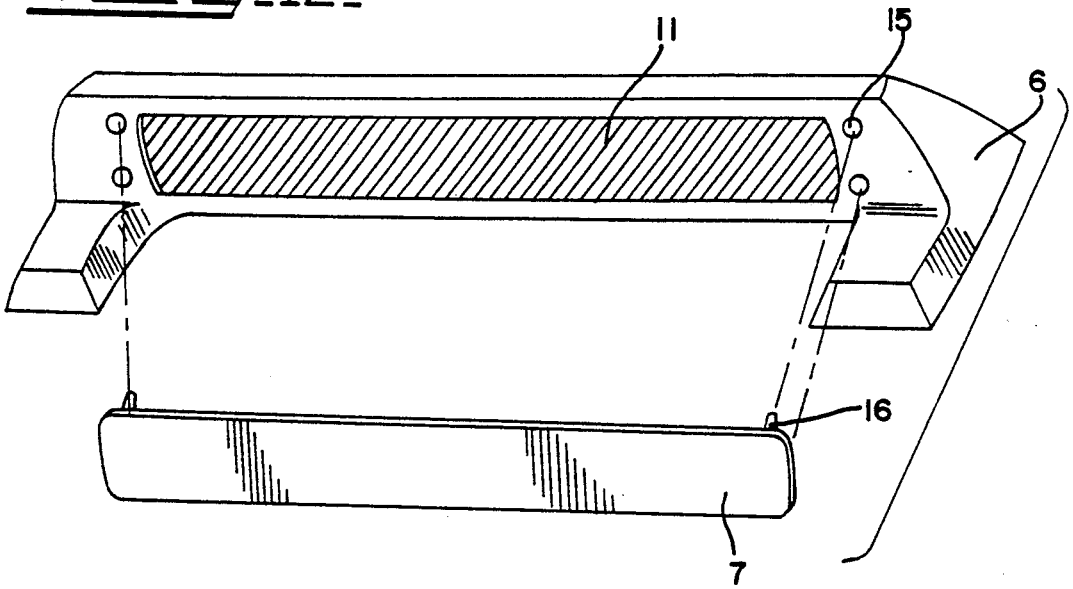
FIG. 42 shows a perspective view of the mounting of a part of the boat of FIG. 40.

The first example of the sheet 7 is a cover type one which can be removed, and, as shown in FIG. 42, it is mounted to the backrest by fitting plugs 16 on the sheet 7 into grommets 15 provided around the opening of the storage compartment in the backrest 6. Thus, the opening of the storage compartment is opened and closed by the mounting and removing this sheet 7.

Figure 43:
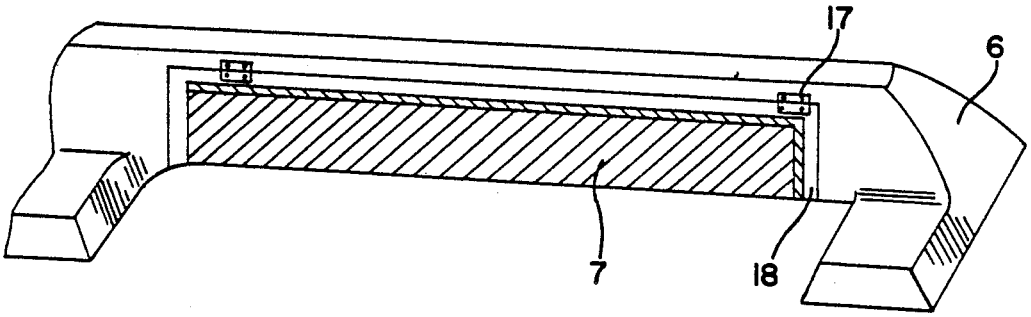
FIG. 43 shows a perspective view of the mounting of an alternative part of the boat of FIG. 40.

The second example of the sheet 7 is a door type, and, as shown in FIG. 43, the sheet is attached to a sheet base plate 18 which is mounted to the backrest 6 via hinges 17. The sheet base plate 18 to which this sheet 7 is attached is opened and closed via the hinges in order to open and close the opening of the storage compartment.

Figure 44:
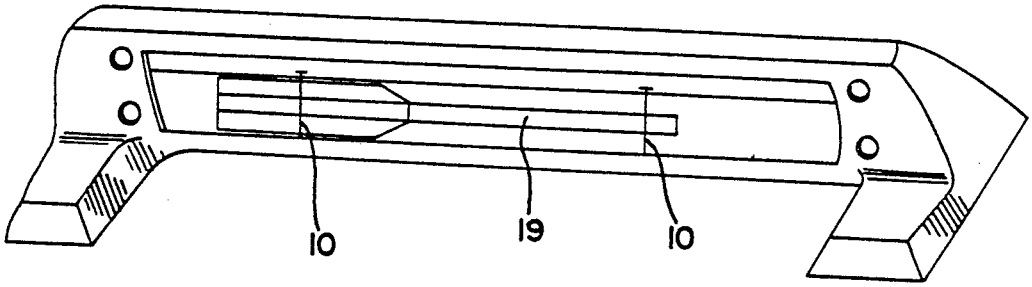
FIG. 44 shows a perspective view of an arrangement for storing articles in a storage compartment of the boat.

FIG. 44 shows the storage of a small article in the storage compartment. In this example, the small article is an oar 19, which is one of the boat's accessories. After this oar 19 is placed inside the storage compartment, it is secured inside the compartment as shown in FIG. 44 using the securing bands 10 already explained using FIG. 41.

With the rear deck construction described above, because the backrest can be mounted and removed, it is possible to remove it when storing or transporting the boat or at other necessary times, thus making the boat more compact and easier to handle.

In addition, because either the sheet provided at the opening can be mounted and removed, or the opening can be opened and closed, it is also possible to use the backrest as a storage compartment, and with this storage compartment, because the backrest itself has a bottom plate, there is no need to provide a special partition for the storage compartment.

What is claimed is:

1. A small boat comprising a boat body forming gunwale parts at the sides thereof, a forward part and a rearward part, said parts forming an operator space for an operator, a helmseat positioned int he operator space at substantially the center of the forward half of the boat, a control stick for steering the boat mounted to the front of said helmseat, an engine mounted in said boat body, and an engine speed control connected to said engine and attached to said control stick adjacent the upper end thereof, said boat body including left and right sides and a bottom side, and left and right channels being provided in the longitudinal direction on said bottom side between the center of said body and said left and right sides, each of said channels including an outboard corner adjacent the associated side, and said bottom side having an inboard surface between each channel and the center of said body, the outboard corner of each of said channels projecting farther downwardly than the plane of the inboard surface of said bottom side.

2. A small boat as described in claim 1, wherein the top surface of each of said channels slants downwardly adjacent the stern end.

3. A small boat comprising a boat body forming gunwale parts at the sides thereof, a forward part and a rearward part, said parts forming an operator space for an operator, a helmseat positioned in the operator space at substantially the center of the forward half of the boat, a control stick for steering the boat mounted to the front of said helmseat, an engine mounted in said boat body, and an engine speed control connected to said engine and attached to said control stick adjacent the upper end thereof, and further including an internal combustion engine, a support member, said engine being mounted on said support member, said support member including a watertight bulkhead through which an output shaft of said internal combustion engine passes, and means for removably mounting said support member to said boat body of said boat so that it is capable of being mounted and removed.

* * * * *